US011812874B2

(12) United States Patent
Coyne

(10) Patent No.: US 11,812,874 B2
(45) Date of Patent: Nov. 14, 2023

(54) BEVERAGE HOLDER

(71) Applicant: Michel Sales Company, Inc., Minneapolis, MN (US)

(72) Inventor: Michael Coyne, Plymouth, MN (US)

(73) Assignee: Michel Sales Company, Inc., Minneapolis, MN (US)

( * ) Notice: Subject to any disclaimer, the term of this patent is extended or adjusted under 35 U.S.C. 154(b) by 0 days.

(21) Appl. No.: 17/473,227

(22) Filed: Sep. 13, 2021

(65) Prior Publication Data

US 2022/0192404 A1 Jun. 23, 2022

Related U.S. Application Data

(60) Provisional application No. 63/127,593, filed on Dec. 18, 2020.

(51) Int. Cl.
*A47G 23/02* (2006.01)
*A45F 3/44* (2006.01)

(52) U.S. Cl.
CPC ..... *A47G 23/0216* (2013.01); *A45F 3/44* (2013.01); *A47G 23/0208* (2013.01); *A45F 2200/0516* (2013.01); *A45F 2200/0583* (2013.01)

(58) Field of Classification Search
CPC ..... A45F 3/44; A45F 2200/0583; A45F 2200/0516; A47G 23/0225; A47G 7/041; A47G 7/044; A47G 7/045; A47G 23/0216; A47G 23/0208; A01G 9/12; A47F 7/0078; A47F 5/04; B62B 3/106; B62B 3/1464

(Continued)

(56) References Cited

U.S. PATENT DOCUMENTS 750,063 A * 1/1904 Redding ..... A47F 7/285 211/74
1,797,077 A * 3/1931 Dew ..... A47G 7/041 248/315

(Continued)

FOREIGN PATENT DOCUMENTS

DE 20315215 U1 * 1/2004 ..... A45F 3/44
DE 202022001103 U1 * 7/2022 ..... A45F 3/44
GB 2501563 B 7/2014

OTHER PUBLICATIONS

"Gold-N-Blacksmith Ornamental Ironwork / Blacksmith / Jewelry", https://www.gnb-llc.com/, retrieved Dec. 2, 2021.

(Continued)

*Primary Examiner* — Taylor Morris
(74) *Attorney, Agent, or Firm* — Billion & Armitage

(57) ABSTRACT

In some embodiments, a beverage holder includes a beverage receptacle, an accessory receptacle, and a shaft. The beverage receptacle defines a cylindrical volume and includes a flat base for supporting a beverage container, the flat base having a circular shape with a first diameter; a first arm having a second diameter and at least partially encircling the cylindrical volume; and a spine connecting the base and the arm. The accessory receptacle defines a rectangular volume and is connected to the base and to the first arm of the beverage receptacle. The shaft includes a first section connected to the base, and a second section with a pointed end for securing the beverage holder into the ground where the first and second sections are connectable by a threaded section.

15 Claims, 24 Drawing Sheets

(58) Field of Classification Search
USPC ..... D7/620, 704; 248/302
See application file for complete search history.

(56) References Cited

U.S. PATENT DOCUMENTS 2,173,024 A * 9/1939 Park ..... A45F 3/44 126/30
2,506,321 A * 5/1950 Vosburgh ..... A47G 23/0225 D6/403
2,520,818 A * 8/1950 Terry ..... A45F 3/44 D8/356
2,603,439 A * 7/1952 Le Vesconte ..... A47G 19/08 248/156
3,995,796 A * 12/1976 Kline ..... A47K 1/08 248/156
4,598,891 A * 7/1986 Hanert ..... A63B 60/58 248/302
4,672,703 A * 6/1987 Frazier ..... A61G 7/0507 248/302
5,570,863 A * 11/1996 Cooper ..... A47G 23/0225 248/156
5,711,502 A * 1/1998 Emalfarb ..... A47H 27/00 248/302
5,727,719 A 3/1998 Veliz et al.
5,745,565 A * 4/1998 Wakefield ..... B60N 3/103 379/426
D398,949 S * 9/1998 Franks ..... D22/100
5,823,360 A * 10/1998 Gorosave ..... A63B 71/0036 211/74
5,823,496 A * 10/1998 Foley ..... A47G 23/0225 248/314
6,065,727 A * 5/2000 Fitzgerald ..... A47C 20/041 248/302
6,193,202 B1 * 2/2001 Rogers ..... B60N 3/103 248/312.1
6,250,912 B1 * 6/2001 Widdowson ..... F23D 3/24 248/312.1
6,575,417 B1 * 6/2003 Krommenakker ..... A47G 23/0225 248/156
6,702,141 B1 3/2004 Cinque
6,766,912 B1 * 7/2004 Gibbs ..... A47G 23/0225 211/74
6,802,484 B1 * 10/2004 Kiley ..... A47G 23/0225 248/311.2
7,207,450 B1 * 4/2007 Franklin ..... A47B 3/04 211/195
D557,929 S * 12/2007 Loggins ..... A47G 23/0208 D6/682.2
D566,480 S * 4/2008 Lawler ..... D7/704
D605,901 S * 12/2009 Price ..... A45F 3/44 D6/405
7,641,157 B2 * 1/2010 Kirkendall ..... A45F 3/44 248/156
8,079,177 B1 * 12/2011 Regner ..... A47G 7/00 47/41.01
D660,102 S * 5/2012 Allred ..... A63B 60/58 D7/704
8,573,138 B2 * 11/2013 Unger ..... A47G 23/0225 108/150
8,857,656 B2 * 10/2014 Marcades ..... A47G 23/02 220/737
9,206,823 B2 * 12/2015 Cingolani ..... A47C 7/006
9,357,829 B1 * 6/2016 Ikier ..... A47G 23/0225
9,398,824 B2 * 7/2016 Krumwiede ..... A47B 55/02
D964,121 S * 9/2022 Voelker ..... A47K 1/08 D7/701
2002/0043181 A1 * 4/2002 Gist ..... A47B 3/12 108/26
2007/0144935 A1 6/2007 Davis et al.
2011/0079696 A1 * 4/2011 Hofferber ..... A47G 23/0225 248/313
2012/0187136 A1 * 7/2012 Smith ..... A45F 3/44 220/737
2012/0199705 A1 * 8/2012 Will ..... A45F 3/44 248/121
2013/0119006 A1 * 5/2013 Graga ..... A47G 23/0208 211/85.18
2014/0146526 A1 * 5/2014 Evans, Sr. ..... A45F 3/44 320/101
2016/0095457 A1 * 4/2016 Deakin ..... B65D 81/3876 29/428
2020/0229628 A1 * 7/2020 Priefert ..... F16B 9/05

OTHER PUBLICATIONS

"Picnic Style-Stemless Wine Glass Holder**4 Outdoor Wine Glass & 1 Wine Bottle Holder-Blacksmith Made-glass-Wine accessories", https://www.etsy.com/listing/534393065/picnic-style-stemless-wine-glass-holder4?ref=as_recently_viewed-1&frs=1, retrieved Dec. 2, 2021.
"Sunnydaze Heavy Duty Outdoor Beverage/Drink Holder Stakes with Side Tray, Set of 2", https://www.amazon.com/Sunnydaze-Outdoor-Beverage-Holder-Stakes/dp/B01E99NCB6/ref=sr_1_1?dchild=1&keywords=30253+decko+double+drink+holder&qid=1597073852&sr=8-1, retrieved Dec. 2, 2021.
"First Examination Report Received dated Jun. 27, 2022", 5 pages.

* cited by examiner

BEVERAGE HOLDER

BACKGROUND

Outdoor social gatherings in warm weather often include eating and drinking. The present invention relates to a beverage holder with a beverage receptacle and an accessory receptacle.

SUMMARY

In some embodiments, a beverage holder includes a beverage receptacle and an accessory receptacle positioned side by side; the beverage receptacle defines a cylindrical volume and includes: a flat base for supporting a beverage container, the flat base having a circular shape with a first diameter; a first arm having a second diameter and at least partially encircling the cylindrical volume; and a spine connecting the base and the arm; the accessory receptacle defines a rectangular volume and is connected to the base and to the first arm of the beverage receptacle; and a shaft comprising a first section connected to the base, and a second section with a pointed end for securing the beverage holder into the ground where the first and second sections are connectable by a threaded section.

In another aspect, a beverage holder includes a beverage receptacle and an accessory receptacle positioned side by side: the beverage receptacle defines a cylindrical volume, has a first height, and includes: a flat base for supporting a beverage container, the flat base having a circular shape with a diameter; a first arm positioned above the flat base; a second arm positioned above the first arm, wherein the first height is measured from the flat base to the second arm; a spine connecting the base and the first and second arms, the spine includes: a first curved section that extends between the first section of the shaft and a horizontal section of the spine, where the horizontal section extends under, and is connected to the base; and a second curved section extends between the horizontal section and a vertical section, the vertical section is connected to the first and second arms of the beverage receptacle; the accessory receptacle defines a rectangular volume, has a second height equal to the first height, where the accessory receptacle is connected to the flat base, the first arm, and the second arm of the beverage receptacle; and a shaft that includes: a first section connected to the base and a second section with a pointed end for securing the beverage holder into the ground, where the first and second sections are connectable by a threaded section.

In another aspect, a beverage holder includes a beverage receptacle and an accessory receptacle positioned side by side: the beverage receptacle has a first height, defines a cylindrical volume, and includes: a flat base for supporting a beverage container, the flat base having a circular shape with a diameter; a first arm positioned above the flat base; a second arm positioned above the first arm, wherein the first height is measured from the flat base to the second arm; and a spine connecting the base and the arm, the spine includes: a first curved section extending between the first section of the shaft and a horizontal section of the spine, the horizontal section extending under, and connected to the base; and a second curved section extending between the horizontal section and a vertical section, the vertical section connected to the first and second arms of the beverage receptacle; the accessory receptacle defines a rectangular volume, has a second height less than the first height, and includes a bottom with a u-shaped portion with a depth, where the accessory receptacle is connected to the flat base and the first arm of the beverage receptacle; and a shaft that includes a first section connected to the base and a second section with a pointed end for securing the beverage holder into the ground, where the first and second sections connectable by a threaded section.

BRIEF DESCRIPTION OF DRAWINGS

This written disclosure describes illustrative embodiments that are non-limiting and non-exhaustive. Reference is made to illustrative embodiments that are depicted in the figures, in which.

DETAILED DESCRIPTION

Eating, drinking, talking, and playing games are common activities of outdoor social gatherings. However, holding a drink and/or an accessory item while participating an activity can be problematic. A beverage holder 10 as disclosed herein frees the hands of a user so that they may participate in an outdoor activity, e.g. play a game, eat, talk with others, or sleep, and have their beverage and/or accessory nearby and off the ground. Beverage holders 10 described herein have a beverage receptacle 20 and an accessory receptacle 40 (see e.g. FIGS. 1, 8, 12-13, 17, and 23).

Figure 7:
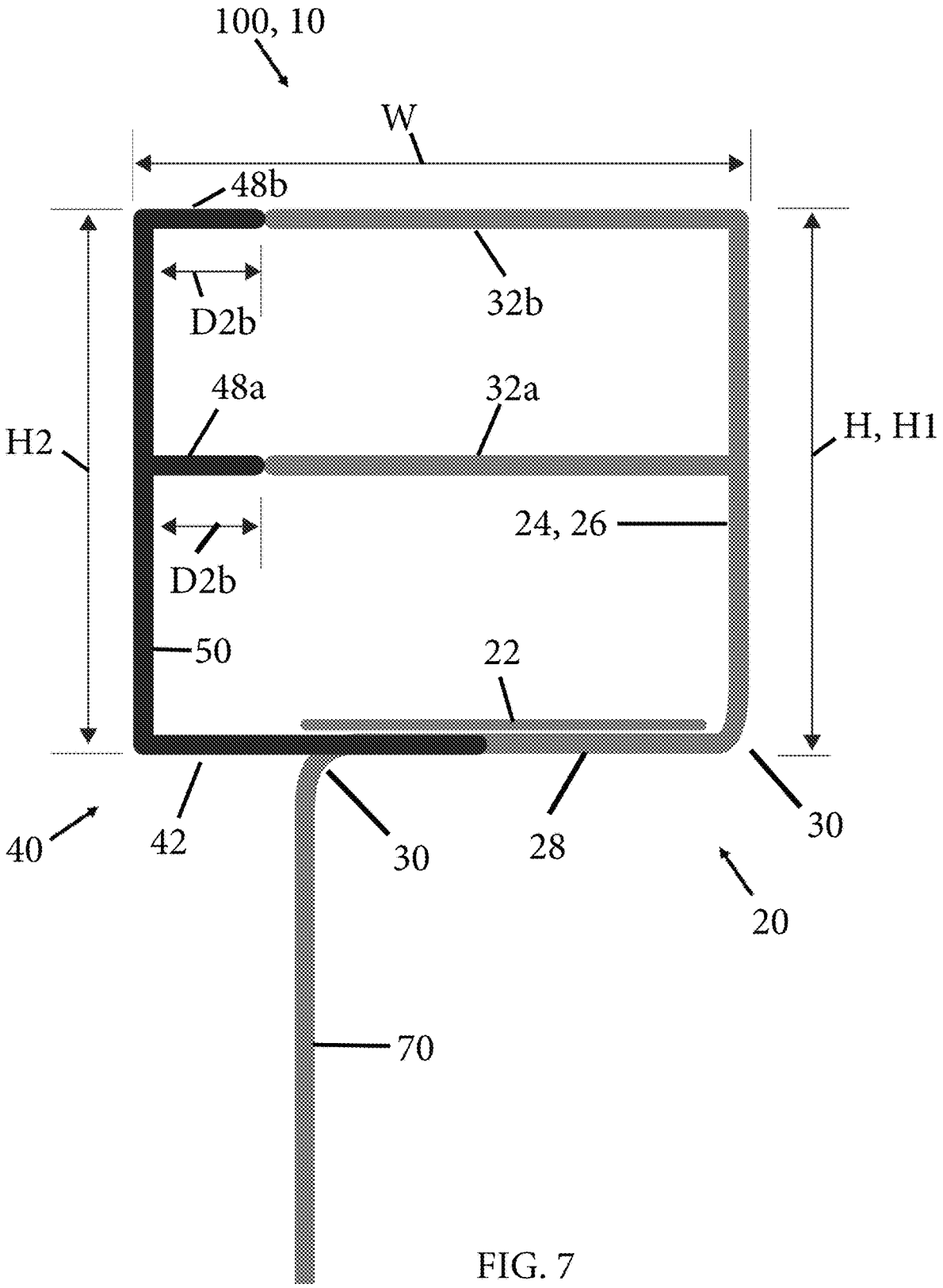
FIG. 7 illustrates a side view of the beverage holder of FIG. 1.

The beverage holder 10 has a height H and a width W (see e.g. FIG. 7). In some embodiments, the beverage holder has a height H ranging from approximately 3 inches to approximately 10 inches and a width W of approximately 4 inches to approximately 11 inches.

Although the beverage holders 10 shown in FIGS. 1-13, 17, and 23 have the beverage receptacle 20 and accessory receptacle 40 positioned side-by-side in a horizontal direction alternative positions are possible. For example, the beverage receptacle and the accessory receptacle may be positioned side-by-side in a vertical direction (different vertical positions on the same side of the shaft 70), or at the same vertical position on the shaft 70 but not positioned opposite one another, e.g. the beverage receptacle may be at a 90° angle to the accessory receptacle. Depending on the positions of the beverage receptacle 20 and the accessory receptacle on the shaft 70, the beverage holder 10 may include a counterweight. A benefit of positioning the beverage receptacle and accessory receptacle side-by-side in a horizontal direction is that both receptacles are easy to access.

Figure 1:
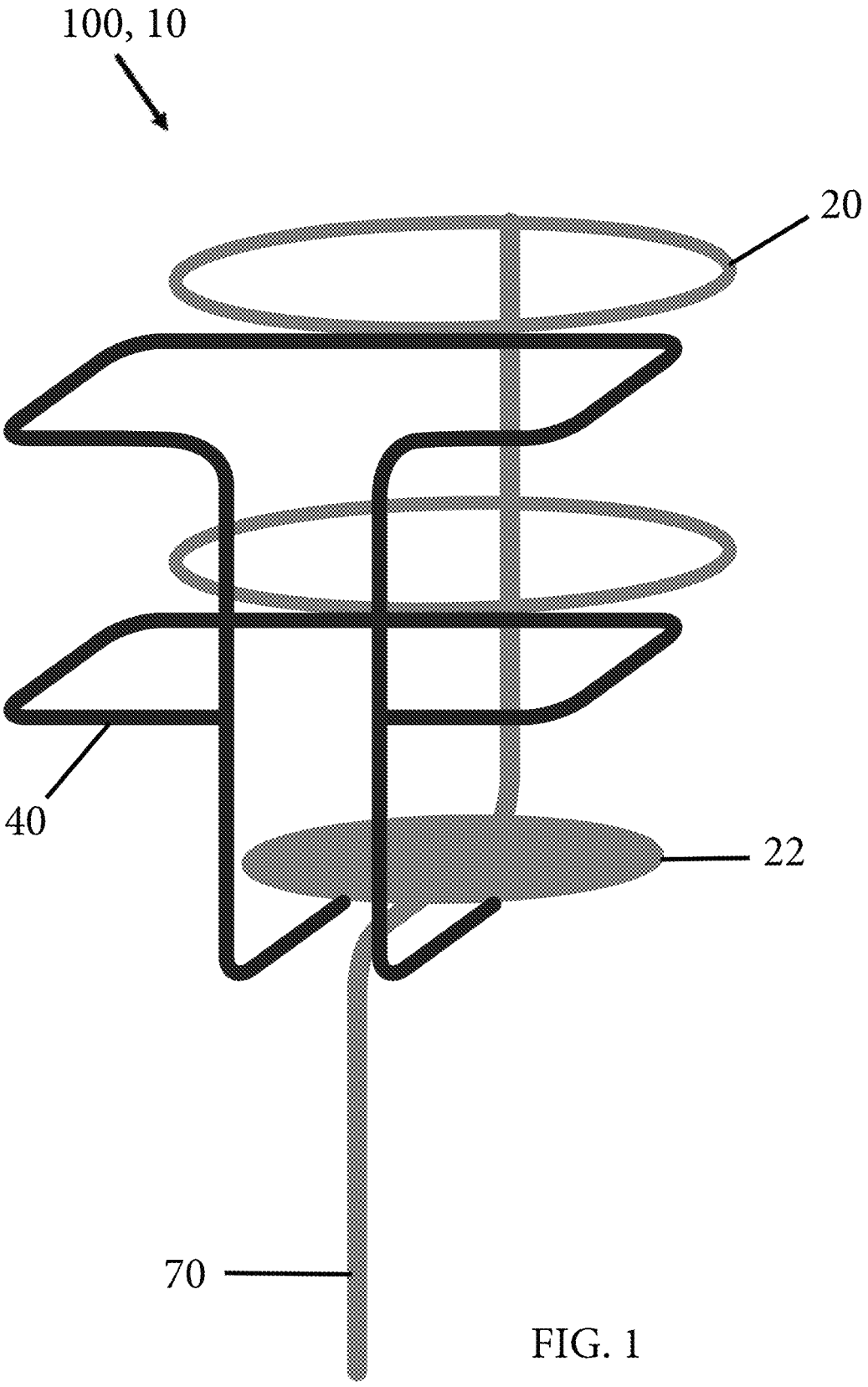
FIG. 1 illustrates a perspective view of a beverage holder according to some embodiments of this disclosure.
Figure 23:
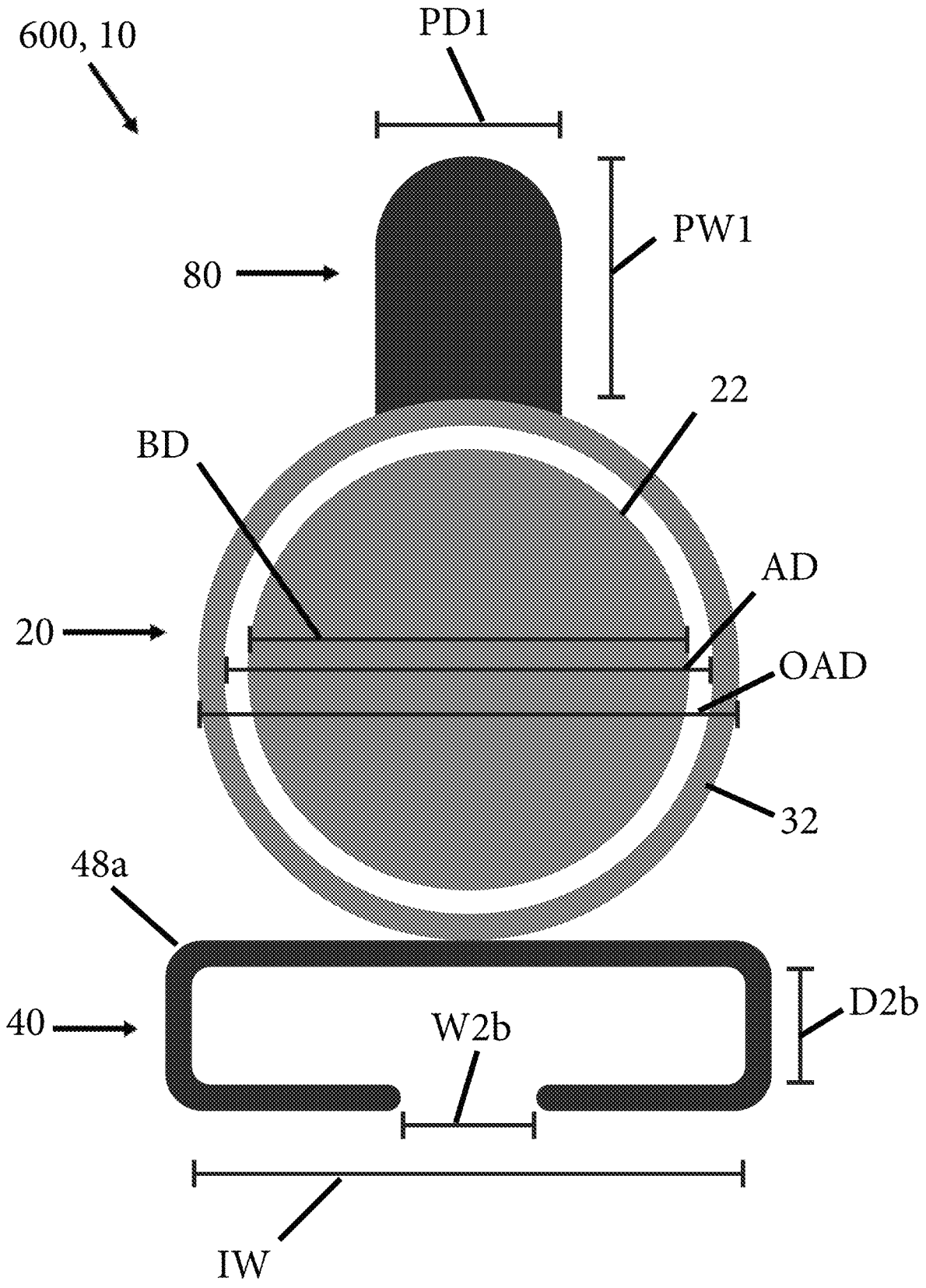
FIG. 23 illustrates a top view of a beverage holder with a mounting device, according to some embodiments of this disclosure.

In some embodiments, the beverage receptacle 20 and the accessory receptacle 40 are connected by their arms 32, 48 (see e.g. FIGS. 1 and 23). In other embodiments of the beverage holder, the beverage receptacle and the accessory receptacle are not connected by their arms. For example, a spine 24 may connect the beverage receptacle and accessory receptacle (see e.g. FIG. 18). In at least one embodiment, the base includes a counterweight to balance the weight of an accessory intended to be placed in the accessory receptacle.

A beverage holder 10 as described herein may be made of any suitable material, for example, steel. In one example, the beverage holder 10 is manufactured by welded steel construction. The components of a beverage holder 10 described herein may have any suitable cross-sectional shape, for example, circular, square shape, and/or rectangular. In one example, the beverage holder is made of steel rods with a diameter of approximately 0.125 inches.

A beverage holder 10 as described herein may be unitary or integral, e.g. made of a single piece of material, or made of more than one piece of material. Thus, when two or more components are discussed as connected, this can also mean the parts are one-piece or integral. In some embodiments, one piece of material forms both the beverage receptacle 20 and the accessory receptacle 40. In other embodiments, more than one piece of material forms the beverage holder 20. Any suitable means may be used to connect or attach components or pieces of material. An example of one suitable means is welding.

A. BEVERAGE RECEPTACLE

Figure 2:
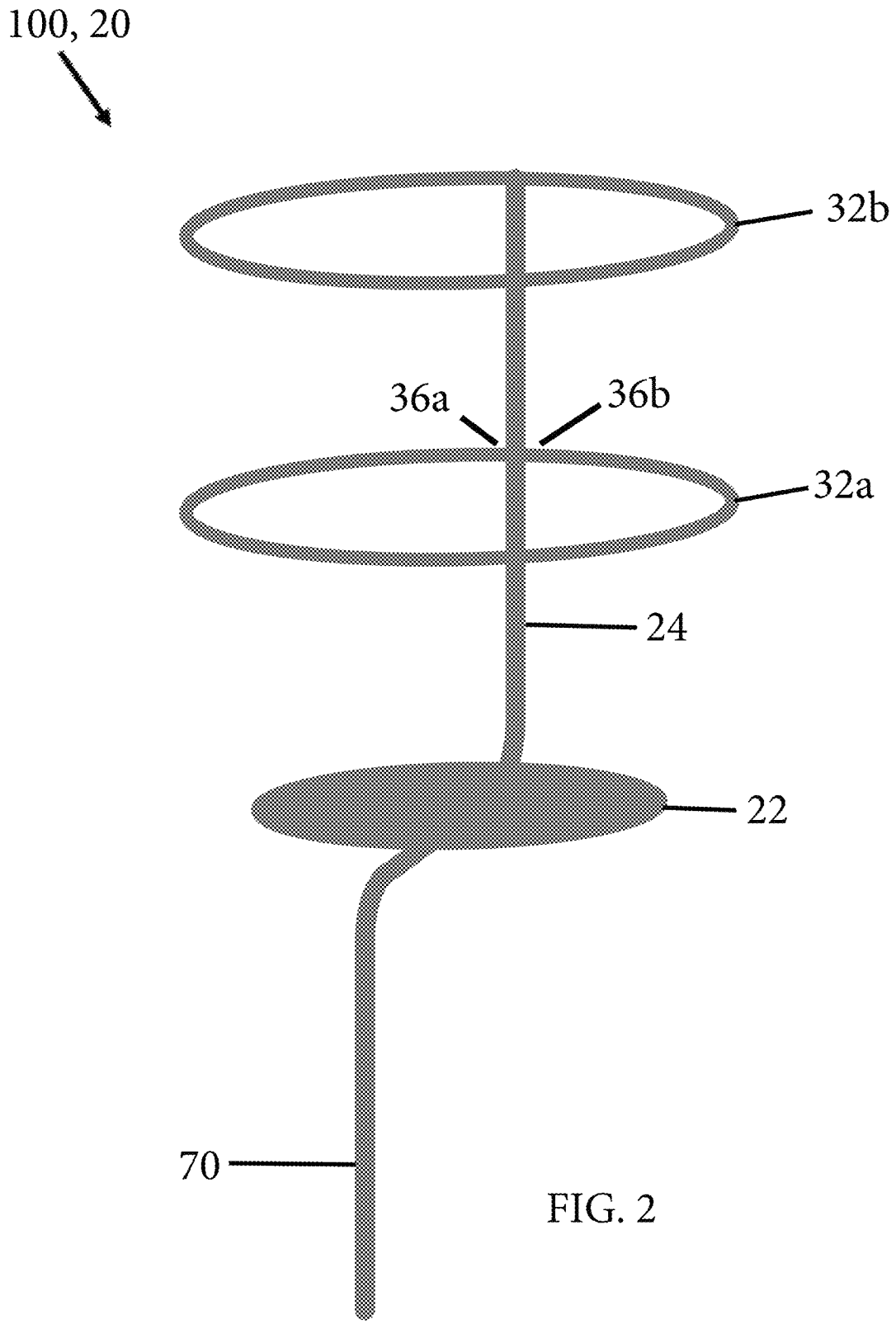
FIG. 2 illustrates a perspective view of the beverage receptacle of the beverage holder of FIG. 1.

The beverage receptacle 20 defines a cylindrical volume sized to receive and hold a beverage container, e.g. a can, a bottle, or a cup (see e.g. FIG. 2). The beverage receptacle 20 has a height H1 and a diameter D1 (see e.g. FIGS. 7-8 and 10). The height of the beverage receptacle may be less than the height of the intended beverage container so that the user may easily insert/retrieve the beverage container in/out of the beverage receptacle. In some embodiments, the height H1 ranges from approximately 4 inches to approximately 6 inches and the diameter D1 ranges from approximately 3 inches to approximately 4 inches. In other embodiments, the height H1 ranges from approximately 1.5 inches to approximately 6 inches and the diameter D1 ranges from approximately 3 inches to approximately 6 inches.

In at least one embodiment, the beverage receptacle 20 has a flat base 22 (see e.g. FIGS. 2, 8, 12-13, 17, and 23). Base 22 is constructed to support a beverage container. The base may have any suitable shape. In some embodiments, the base 22 is circular (see e.g. FIGS. 4, 9, 17, and 23). The base may be a piece of solid material or a mesh. In some embodiments, the base 22 extends between and is connected to the spine 24 and to the accessory receptacle 40 (see e.g., FIGS. 1 and 8). The base 22 has a diameter BD that is sufficiently large to support the intended beverage container. In some embodiments, the diameter BD is approximately 3 inches to approximately 3¼ inches. In other embodiments, the diameter BD is at least 2 inches.

In at least one embodiment, the beverage receptacle 20 further includes at least one arm 32. In some embodiments, arm 32 has a first end 36*a* connected to the spine 24 and a second end 36*b* connected to the spine 24 so that the arm 32 encircles the cylindrical volume defined by the beverage accessory 20 (see e.g. FIGS. 1, 8, and 12-13). In some embodiments, the first and second ends 36*a,b* of the arm 32 are connected to the same vertical position along the spine 24 (see e.g. FIGS. 1 and 8). In these embodiments, arm 32 is parallel to base 22.

Figure 15A:
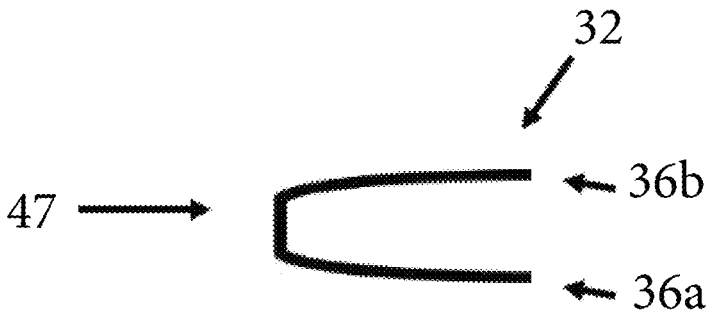
FIGS. 15A-B illustrate a flat view of arms according to some embodiments of this disclosure.
Figure 15B:
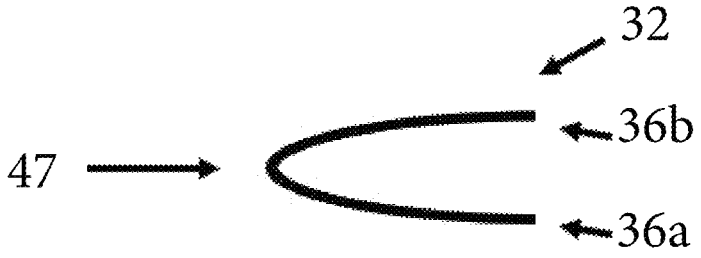

In other embodiments, the first and second ends of arm 32 may be connected to different vertical positions along the spine. For example, the ends of a u-shaped arm would be connected to different positions along the spine 24. FIGS. 15A-B show some examples of u-shaped arms 32. The u-shaped arm 32 has a middle region 47 that may be straight or curved (see e.g. FIGS. 15A-B). Two u-shaped arms 32 may be connected by their middle regions 47 so that they encircle the cylindrical volume defined by the beverage accessory 20 (see e.g. FIG. 18).

In other embodiments, the arm 32 partially encircles the cylindrical volume defined by the beverage accessory 20. For example, a first end of the arm may be connected to the spine and a second end of the arm may be connected to the accessory receptacle. As another example, the beverage receptacle 20 may have two u-shaped arms 32 that each partially encircles the cylindrical volume defined by the beverage receptacle 20.

The base 22 and arms 32 may be separated by the same distance or by different distances. The diameter AD defined by the arm(s) 32 may be equal to or greater than the diameter BD of the base 22. The arm(s) 32 may define a diameter AD ranging from approximately 3 inches to approximately 4 inches.

In some embodiments, the beverage receptacle 20 further includes at least one spine 24. In at least one embodiment, the spine 24 connects the base 22 and the arm(s) 32. The spine 24 may be straight or curvilinear. In one example, a curvilinear spine 24 includes a vertical section 26 and a horizontal section 28 connected by a curved section 30 (see e.g. FIG. 16). In another example, a curvilinear spine 24 includes a curved section 30 connecting two relatively straight sections (see e.g. FIG. 17). In some embodiments, the horizontal section 28 of the spine 24 extends underneath the base 22. In some embodiments, spine 24 may be an extension of the shaft 70. In these embodiments, the beverage receptacle 20 and the securement device, shaft 70, are integral. In other embodiments, the beverage receptacle 20 does not include a spine (see e.g. FIG. 24).

In some embodiments, the beverage receptacle 20 is unitary, i.e. formed of a single piece of material. In other embodiments, the beverage receptacle 20 is formed of at least two pieces of material. For example, the spine 24 and the arms 32*a,b* may be one piece of material and the base 22 a separate piece of material.

B. ACCESSORY RECEPTACLE

The accessory receptacle 40 defines a rectangular volume sized to receive and hold an accessory item such as a phone, a tablet, an e-reader, a book, a wallet, and/or keys. The accessory receptacle 40 may have a height H2 equal to, greater than, or less than the height H1 of the beverage receptacle 20. The height H2 may be greater than the width W2 (see e.g. FIGS. 5 and 10). The accessory receptacle 40 may have a height H2 ranging from approximately 1 inch to approximately 10 inches, a width W2 ranging from approximately 2 inches to approximately 7 inches, and/or define an internal depth D2*b* ranging from approximately 2 inches to approximately 1.5 inches. For example, the depth of the accessory holder is D2B+2*(thickness of arm 48) (see, e.g. FIGS. 4 and 9).

In some embodiments, the accessory receptacle 40 is unitary, i.e. formed of a single piece of material. In other embodiments, the accessory receptacle 40 is formed of at least two pieces of material. For example, the horizontal support member 42, the segments 50 and arm 48*b* may be one piece of material and the arm 48*a* a separate piece of material (see e.g. FIG. 3).

B.1. First Accessory Receptacle Embodiment

Figure 8:
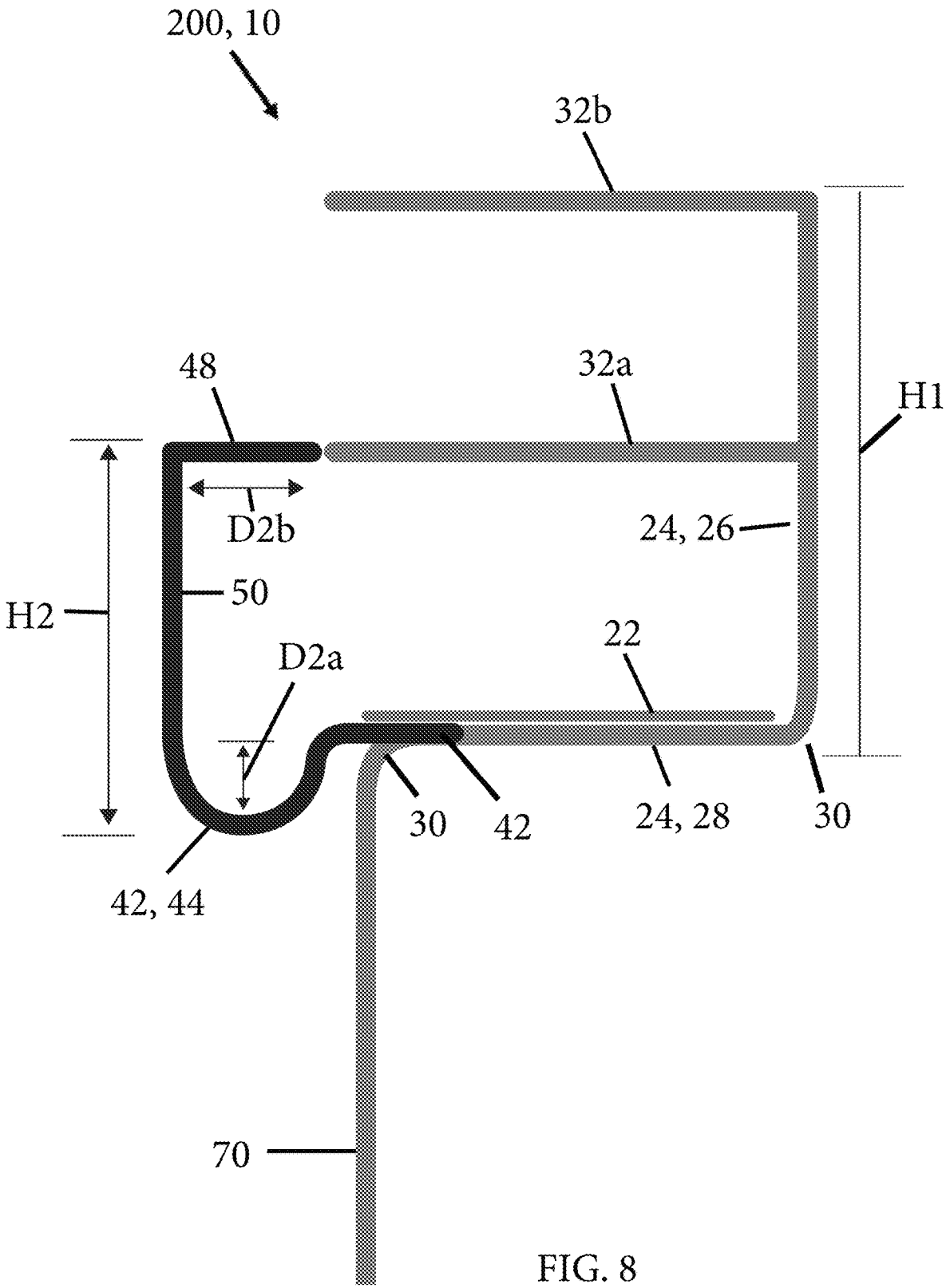
FIG. 8 illustrates a side view of a beverage holder according to some embodiments of this disclosure.
Figure 17:
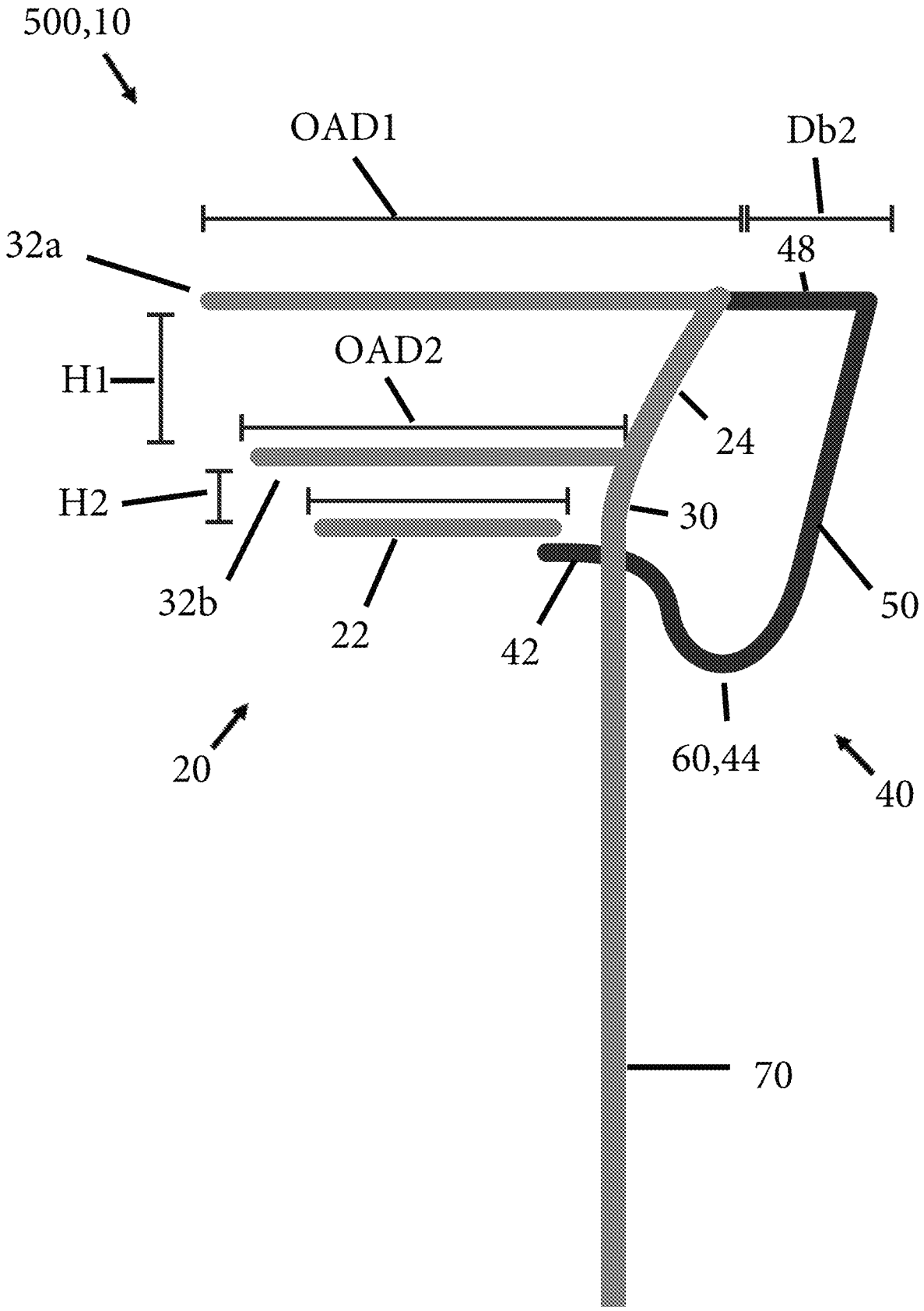
FIG. 17 illustrates a side view of a beverage holder, according to some embodiments of this disclosure.

In some embodiments, the accessory receptacle 40 includes at least one horizontal support member 42, at least one arm 48, and at least one segment 50 (see e.g. FIGS. 1, 8, and 17). Segment 50 may extend vertically, as shown in FIG. 8 or at a non-vertical angle, as shown in FIG. 17. In some embodiments, the accessory receptacle 40 has two horizontal support members 42. The horizontal support members 42 may be separated by a distance W2*b* of approximately 0.5 inches to approximately 2 inches. The horizontal support members 42 may be parallel as or non-parallel. In some embodiments, the horizontal support members 42 are straight (see e.g. FIGS. 3 and 7). In other embodiments, the horizontal support members 42 are curvilinear. For example, the horizontal support member 42 may include a u-shaped portion 44 having a depth D2*a* (see e.g. FIGS. 8 and 17). The depth D2*a* of the u-shaped portion 44 may range from approximately 0.5 inches to approximately 1 inch. The u-shaped portion 44 may be curved or square-shaped.

In some embodiments, arm 48 extends from a first segment 50*a* to a second segment 50*b* (see e.g. FIGS. 1 and 8). The arm(s) 48 may have any suitable shape to hold/contain an accessory. For example, when viewed from above, the arm(s) 48 may have a rectangular shape (see e.g. FIGS. 4 and 18) or the arm(s) 48 u-shaped as shown in FIGS. 15A-B. The arm(s) 48 may define an internal width IW (width of the rectangular volume) of approximately 2.5 inches to approximately 6.5 inches. In at least one embodiment, the arm(s) 48 have a depth less than the depth of the horizontal support member 42 (see e.g. FIGS. 7 and 8).

B.2. Second Accessory Receptacle Embodiment

Figure 12:
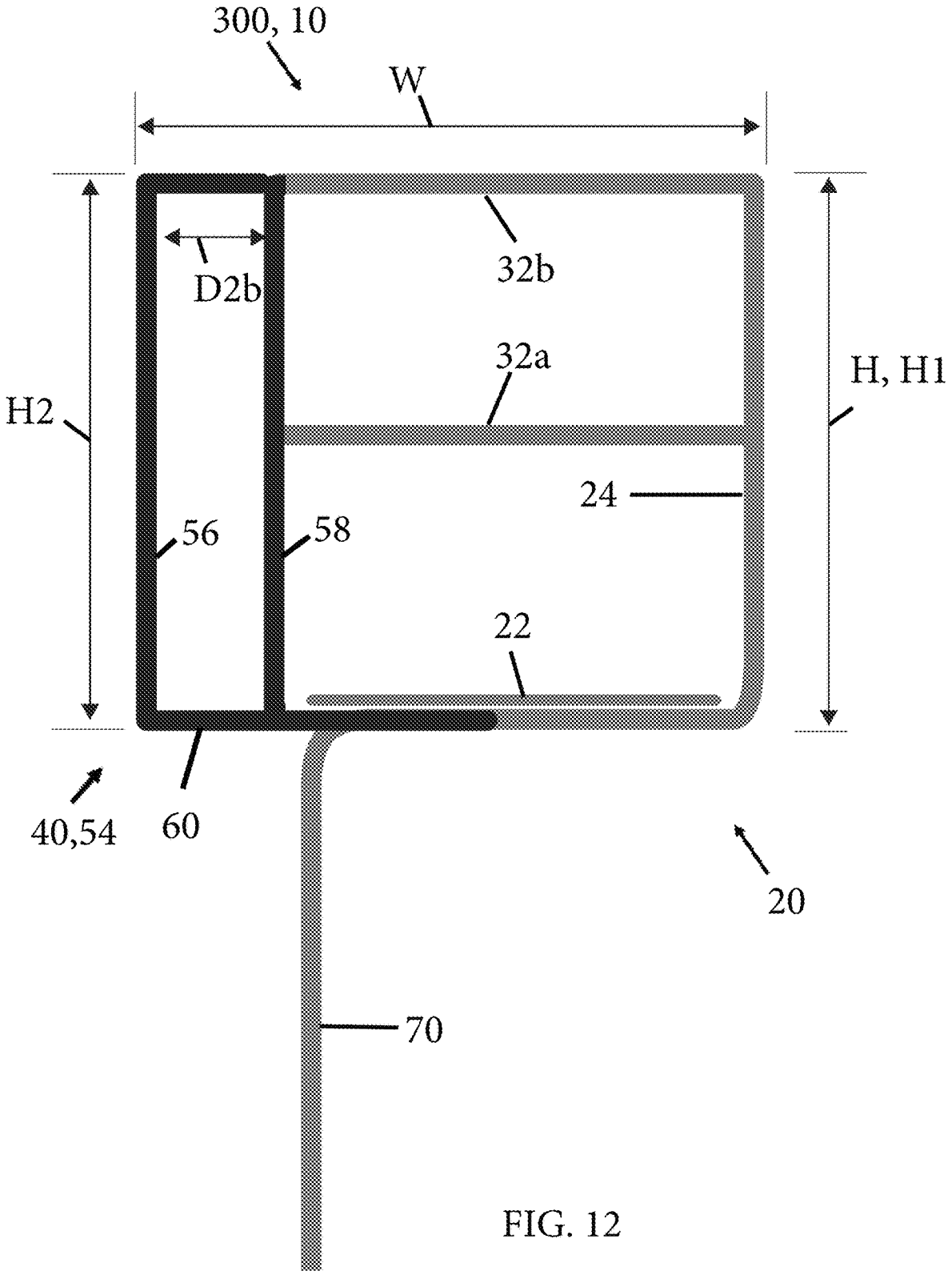
FIG. 12 illustrates a side view of a beverage holder, according to some embodiments of this disclosure.
Figure 13:
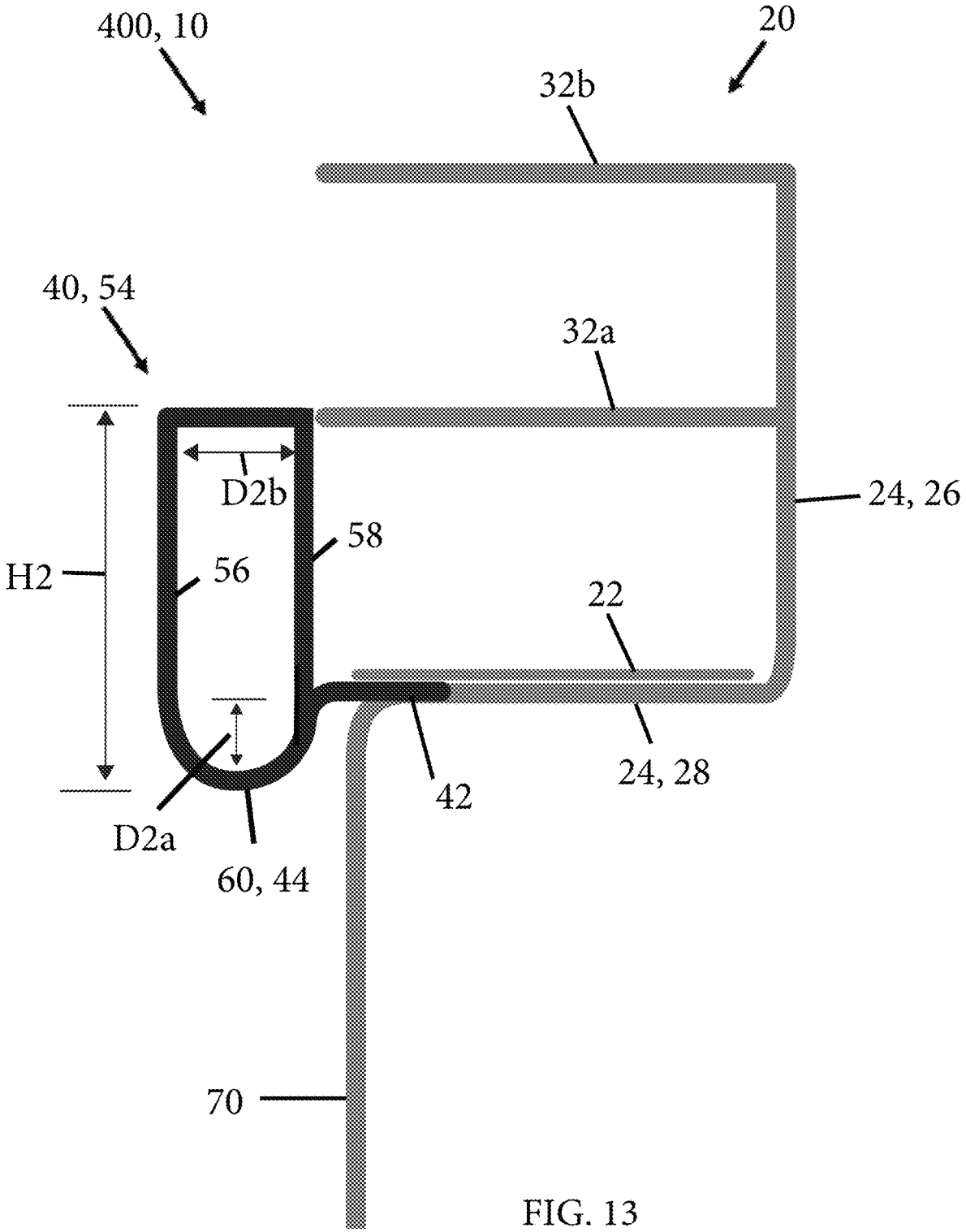
FIG. 13 illustrates a side view of a beverage holder according to some embodiments of this disclosure.

In other embodiments, the accessory receptacle 40 is a box 54 (see e.g. FIGS. 12-13). Box 54 has a front wall 56, a rear wall 58, sidewalls, and a bottom 60 (see e.g. FIGS. 12-13). The top of box 54 may be open or have a lid. The bottom 60 of box 54 may be a solid material, may include one or more holes, or may be formed of at least one horizontal support member. A benefit of having a bottom 60 with at least one hole, or formed by support members, is that liquid can drain from box 54 and/or provide for air circulation in box 54. The bottom 60 of the box may be flat or may include a u-shaped portion with a depth D2*a* ranging from approximately 0.5 inches to approximately 1 inch. (see e.g. FIGS. 12-13).

Box 54 may be connected to the base 22 and/or an arm 32 of the beverage receptacle 20. In some embodiments, box 54 is connected by at least one horizontal support member 42. The horizontal support member 42 may be an extension of the bottom 60 of the box 54 (e.g. embodiments where the horizontal support members 42 form the bottom 60) or a separate piece of material connecting the bottom 60 of the box 54 to the base 22. In some embodiments, the horizontal support member(s) extends at least partially underneath the bottom 60 of the box 54 and partially underneath the base 22.

The front and rear walls 56,58 may be made of a solid material or a mesh. The height of the rear wall 58 may be the same as or greater than the height of the front wall 56. The height of the walls 56, 58 may range from approximately 1 inch to approximately 10 inches. The front and rear walls 56, 58 are separated by a distance D2*b* ranging from approximately 0.5 inches to approximately 3 inches.

Figure 4:
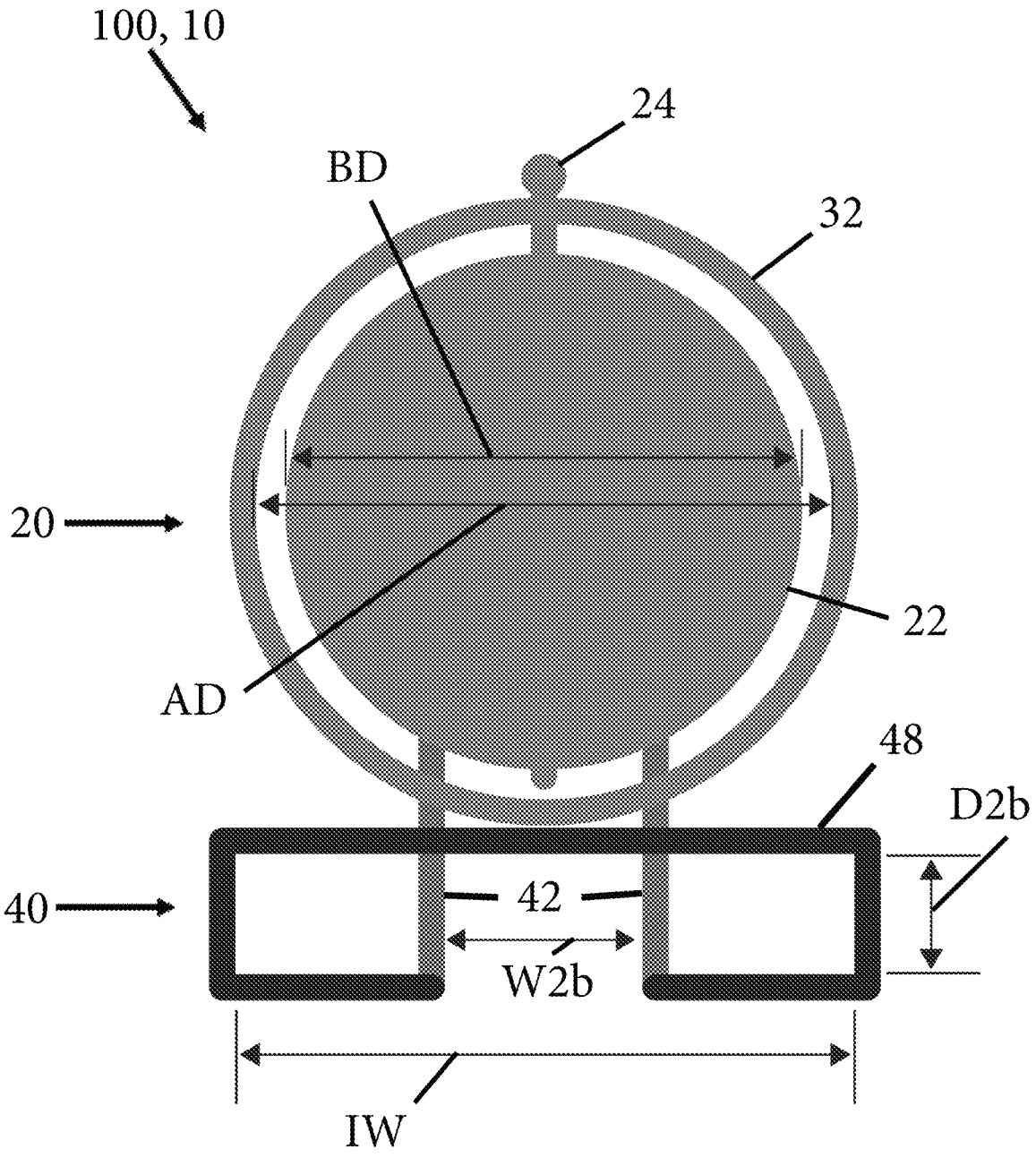
FIG. 4 illustrates a top view of the beverage holder of FIG. 1.
Figure 9:
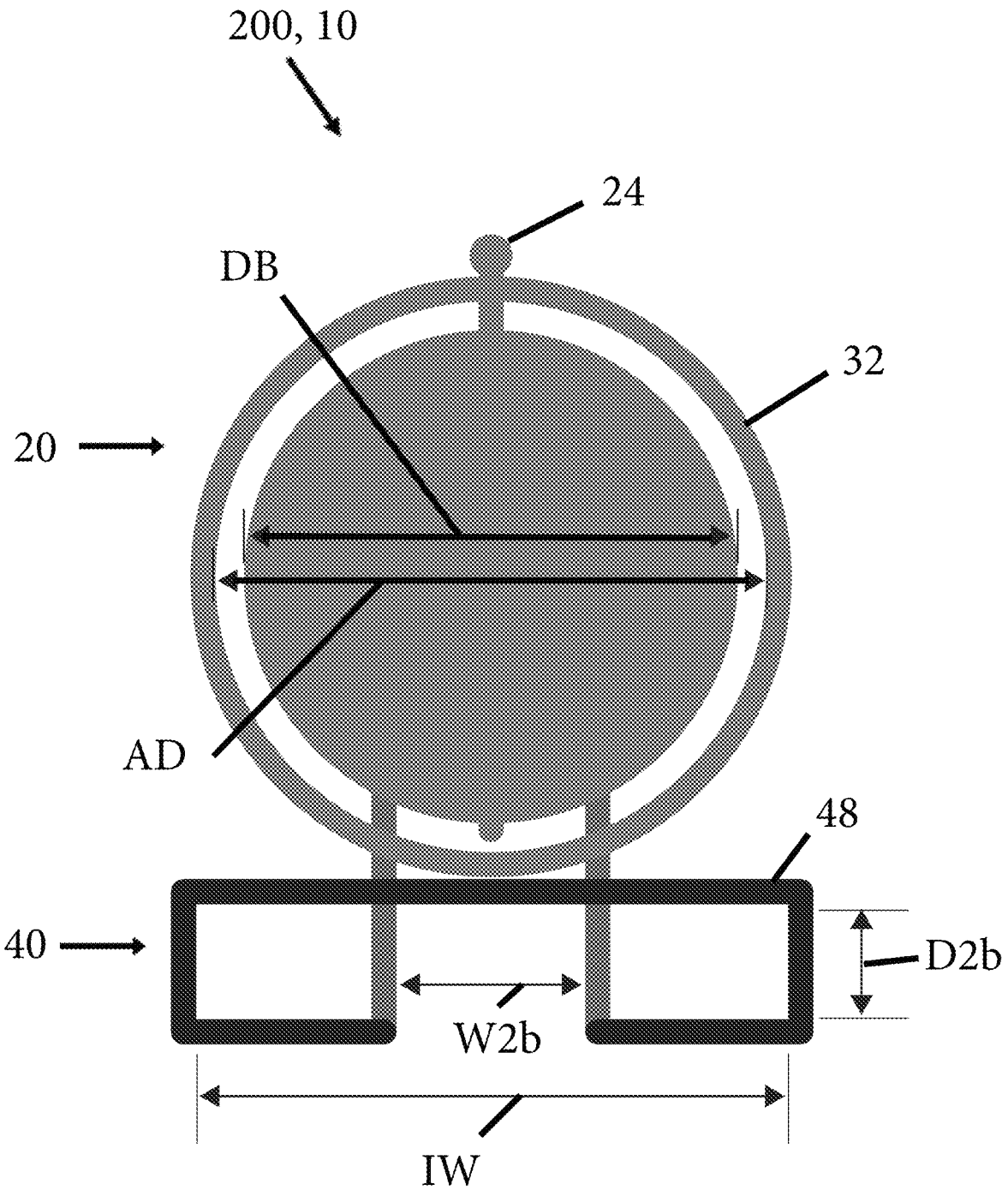
FIG. 9 illustrates a top view of a beverage holder of FIG. 8.

The sidewalls may be made of solid material, a mesh, or at least one horizontal support member (for simplicity, the sidewall is omitted from the side views of FIGS. 12-13). The side walls are separated by an internal width IW of approximately 1.5 inches to approximately 6.5 inches (measurement IW as shown in FIGS. 4 and 9).

C. SECUREMENT DEVICES

A beverage holder 10 as described herein at least one securement device configured to allow hands-free access to a beverage container being held by the beverage holder 10. For example, the securement device may be configured to insert the beverage holder into the ground or to attach the beverage holder to another object. In this way, the user's hands are free for other things. In some embodiments, the beverage holder 10 has one securement device. In other embodiments, the beverage holder 10 has two securement devices.

C1. Shaft

Figure 14A:
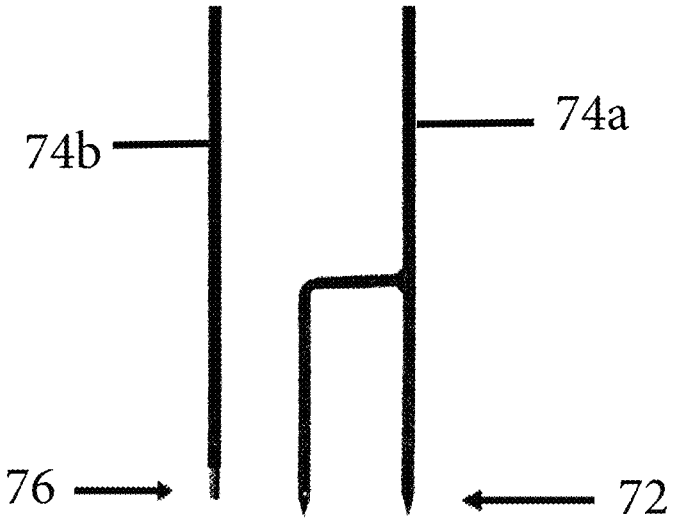
FIGS. 14A-B illustrate a shaft of a beverage holder according to some embodiments of this disclosure.

Some of the beverage holders 10 described herein have a shaft 70 with at least one pointed end 72 to insert the beverage holder 10 into the ground (see e.g. FIG. 14A). In some embodiments, the shaft 70 has an h-design with two pointed ends 72 (see e.g. FIG. 14A). Alternative configurations of the shaft 70 are contemplated. For example, in one example, the shaft has four pointed ends positioned at corners of a square. In another example, the shaft has three pointed ends positioned at corners of a triangle. In these embodiments, the pointed ends are distributed evenly about the shaft. In other embodiments, the pointed ends may be distributed unevenly about the shaft.

Figure 14B:
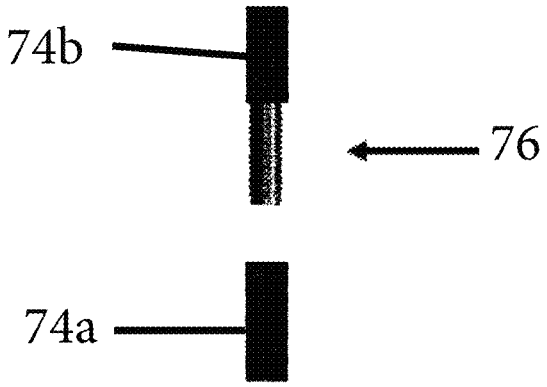

The shaft 70 may be unitary or formed of connectable parts. For example, shaft 70 may be formed of two parts 74*a,b* that are connected/disconnected by screwing (see e.g. FIGS. 14A-B). Other means may be used to connect/disconnect the parts 74 of the shaft 70. A benefit of forming the shaft 70 of connectable parts 74 is that the length of the beverage holder 10 may be reduced for easy transport.

C2. Mounting Device

Some of the beverage holders 10 described herein have a mounting device 80 to secure the beverage holder to another article such as a chair, bench, table, deck rail, or fence rail. In some embodiments, the mounting device is attached to the beverage receptacle 20 and/or to the accessory receptacle 40 (see e.g. FIG. 24). In other embodiments, the mounting device 80 is integral with the beverage receptacle.

Figure 24:
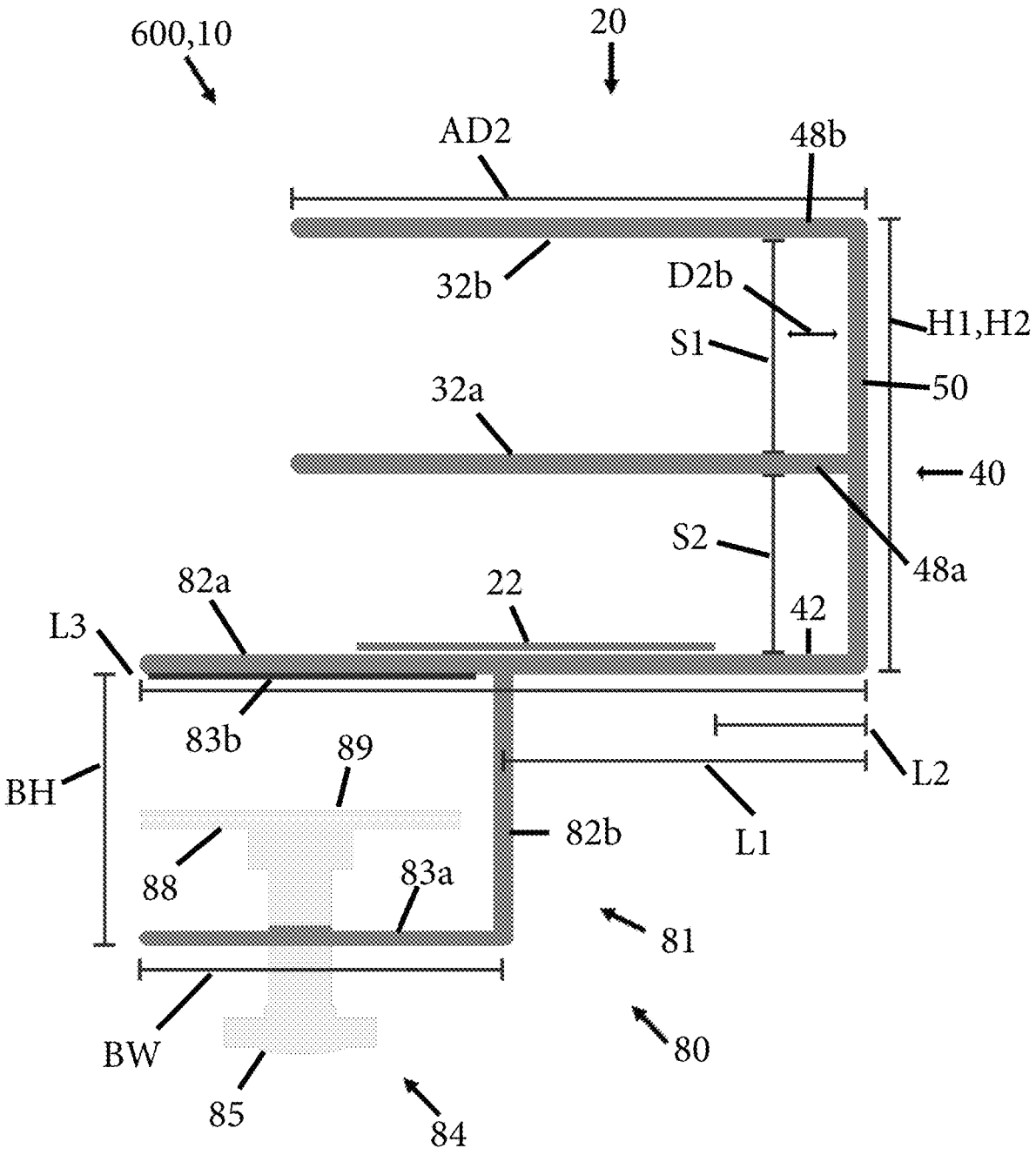
FIG. 24 illustrates a side view of the beverage holder of FIG. 23.

In some embodiments, the mounting device 80 is laterally offset from the beverage receptacle 20. As one example, the left side of the beverage receptacle 20 may be positioned to the right of the left side of the mounting device 80, as shown in FIG. 24. In other embodiments, the mounting device 80 is positioned underneath the beverage receptacle 20 and is sized so that the sides of the mounting device do not extend beyond the sides of the beverage receptacle and accessory receptacle.

The mounting device 80 may have any suitable configuration for securing the beverage holder 10 to another object. In some embodiments, the mounting device 80 is designed so that the object is positioned between two components of the mounting device 80. For example, the mounting device may be a clamp. In at least one embodiment, the mounting device 80 includes a bracket 81 and an adjustment/securement device 84 (see e.g. FIG. 20). Any suitable adjustment/securement device may be used. In some embodiments, the securement device 84 is moveable relative to bracket 80. In use, the securement device 84 is adjusted until the object is securely held between the securement device 84 and bracket 81.

Figure 20:
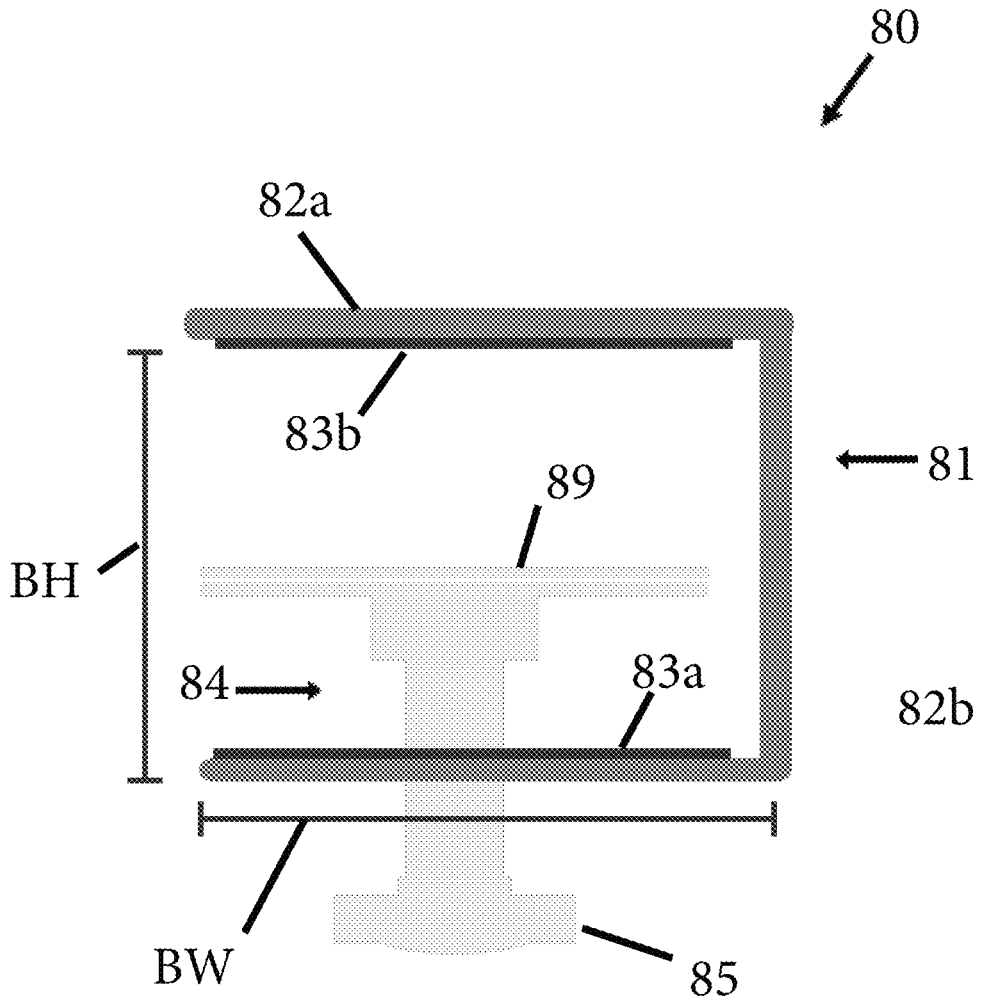
FIG. 20 illustrates a side view of a mounting device for a beverage holder, according to some embodiments of this disclosure.

In at least one embodiment, bracket 81 has at least three sides and defines a volume (see e.g. FIG. 20). In some embodiments, bracket 81 is U-shaped or C-shaped. The sides may be solid or define at least one opening. In some embodiments, a side with one opening may be formed by at least one segment 82 (see e.g. FIG. 25). In at least one embodiment, a bracket 81 has three sides formed by one member 82 that has a segment defining the top 82*a*, a segment defining the side 82*b*, and a segment defining the bottom 82*c*. In some embodiments, the side segments 82*b* are perpendicular to the top segment 82*a* and to the bottom segment 82*c*. In one embodiment, the top and bottom segments 82*a,c* are u-shaped and the side segments 82*b* are parallel to one another. In at least one embodiment, the top segment 82*a* is an extension of another component of the beverage holder. For example, the top segment 82*a* may be integral with the accessory receptacle 40 because the top segment 82*a* is an extension of the horizontal support members 42 of the accessory receptacle 40 (see e.g. FIG. 24). In these embodiments, a member 82 forms the side and bottom of the bracket and the side of the bracket is attached to the horizontal support members 42.

In at least one embodiment, bracket 81 includes at least one bracket plate 83. In some embodiments, bracket 81 has a bottom bracket plate 83*a* and an upper bracket plate 83*b* (see e.g. FIG. 20). In one embodiment, the size of the bracket plates 83 is smaller than the area defined by the bracket 81 (see e.g. FIG. 20). In some embodiments, the bracket plates 83*a,b* are attached to an inner surface of member 82. In some embodiments, the bottom bracket plate 83*a* defines an opening for the adjustment device 84.

Figure 21:
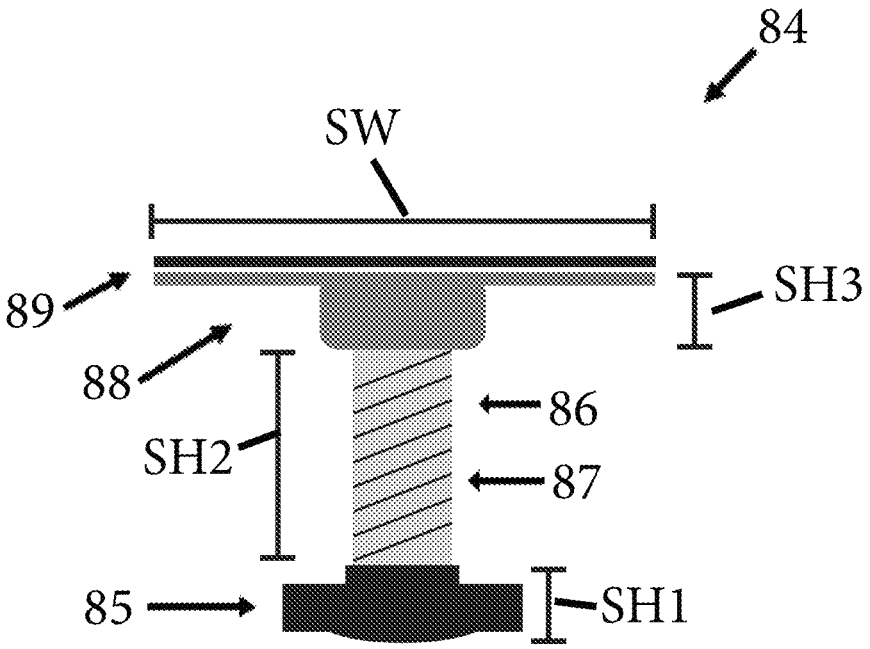
FIG. 21 illustrates a side view of an adjustment device in the form of a screw, according to some embodiments of this disclosure.

An example of an adjustment/securement device 84 that may be used in the mounting device 80 is shown in FIG. 21. This adjustment/securement device embodiment includes a handle/head 85 with a height SH1, a plate 88 with a height SH3, and a shaft 86 with a helical thread 87 and height SH2 extending between and connecting the handle 85 and the plate 88. Plate 88 includes a receptacle for the shaft 86 and has a width SW. In some embodiments, the handle/head 85 is configured to rotate to adjust the distance between plate 88 and the upper bracket plate 83*b*. In one example, height SH1 is 0.5 inches, height SH2 is 1.125 inches, height SH3 is 0.5 inches, and width SW is 2.125 inches.

Figure 22:
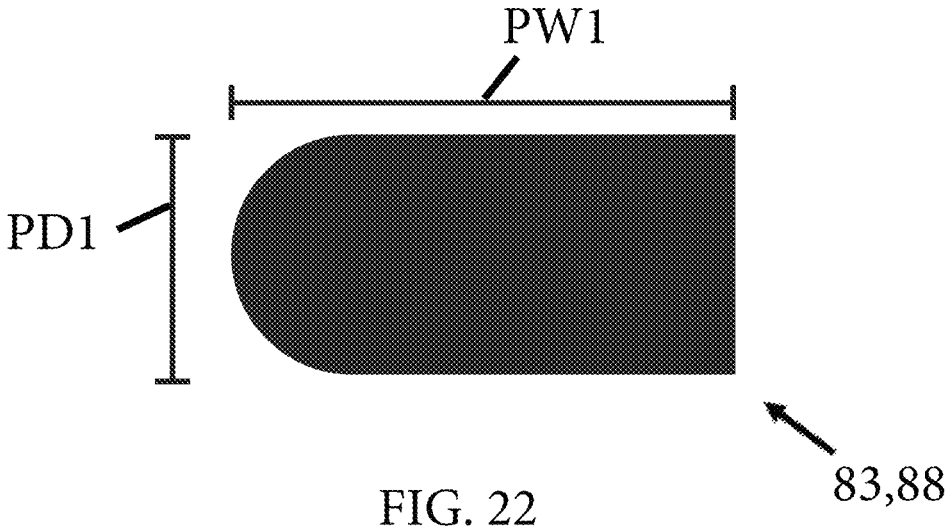
FIG. 22 illustrates an exemplary shape for a plate for the mounting device, according to some embodiments of this disclosure.

An exemplary shape for the bracket plate 83 and/or plate 88 is shown in FIG. 22 where the plate 83 or 88 has a width PW1 and a depth PD1. In at least one embodiment, a pad/coating 89 is provided on the engagement surface of the upper bracket plate 83*b* and/or the plate 88. The pad/coating 89 may cover some or all of the plate 83*b*,88. In some embodiments, the pad/coating 89 is configured to prevent/minimize damage to the object to which the beverage holder 10 is attached. Any suitable material may be used for the pad/coating 89. One example of a suitable material is rubber.

In at least one embodiment, the mounting device 80 includes a receptacle to receive a shaft configured to be inserted into the ground (not shown). For example, the receptacle may be configured to receive a threaded end of a shaft that has at least one pointed end at the other end. For example, part 74*a* of shaft 70 may be inserted into a receptacle of the mounting device.

E. EXAMPLES

Exemplifications of a beverage holder 10 as described above are provided in the following non-limiting examples.

Example 1

FIGS. 1-7 and 16 show a first example 100 of a beverage holder 10 with a beverage receptacle 20 and an accessory receptacle 40. The beverage receptacle 20 and the accessory receptacle 40 are positioned side by side and have the same height H1, H2. In one particular embodiment of example 100, the beverage holder 10 has a height H1, H2 of approximately 4 inches, and a width W of approximately 4.75 inches. The beverage receptacle 20 and the accessory receptacle 40 are each connected to the base 22 (see e.g. FIGS. 1 and 7). The beverage receptacle 20 and the accessory receptacle 40 are also connected by arms 48*a* and 32*a*, and by arms 48*b* and 32*b* (see e.g. FIGS. 1 and 7).

Figure 6:
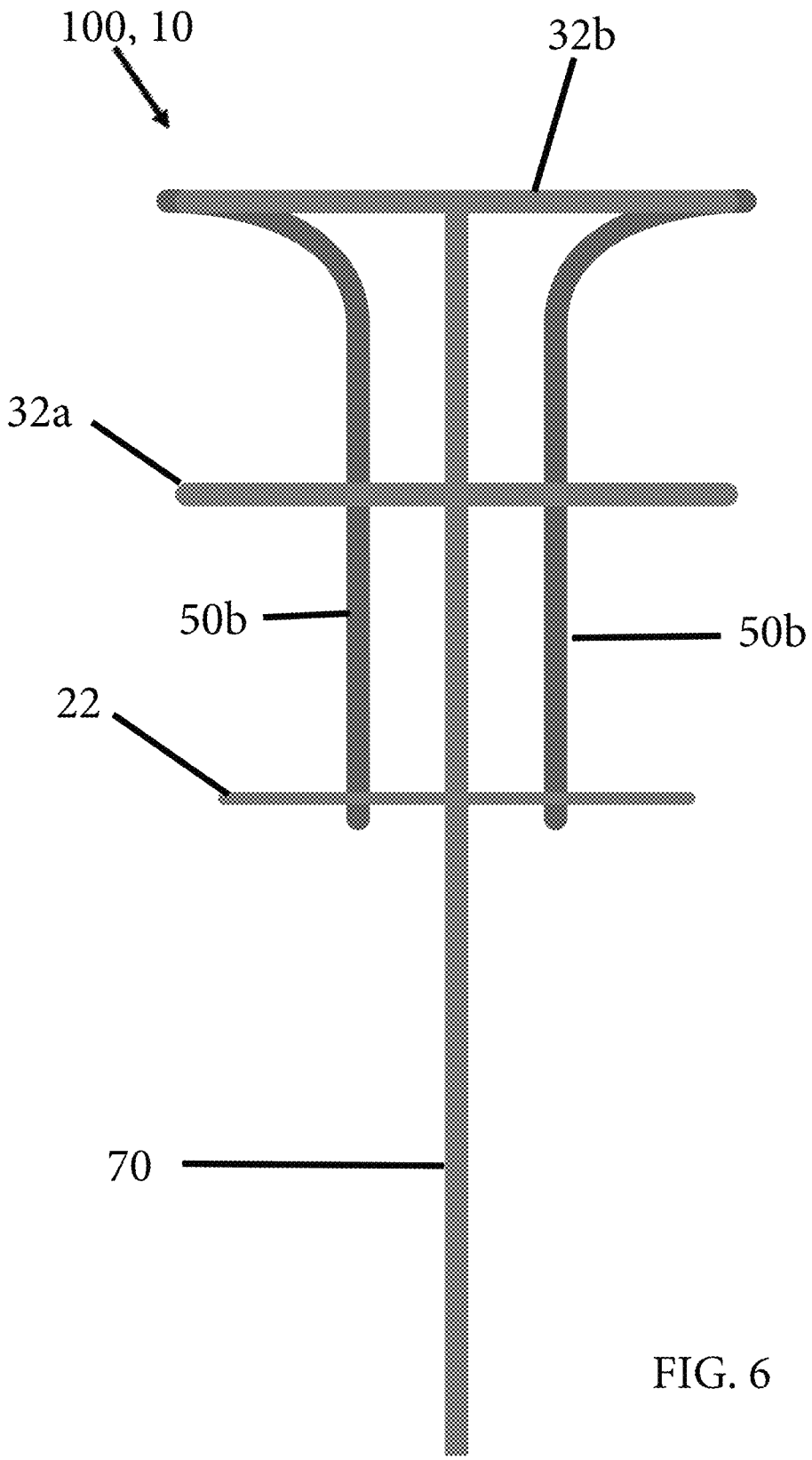
FIG. 6 illustrates a back view of the beverage holder of FIG. 1.

The beverage receptacle 20 has a base 22, two arms 32*a,b*, a spine 24, and a height H1 (see e.g. FIGS. 2 and 6). In one particular embodiment of example 100, the height H1 is approximately 4 inches. When viewed from above, the arms 32*a,b* are parallel to the base 22 and form a circular shape with a diameter AD greater than the diameter DB of the base 22 (see e.g. FIG. 4). In one particular embodiment of example 100, diameter BD is approximately 3 inches and diameter AD is approximately 3.125 inches.

Figure 16:
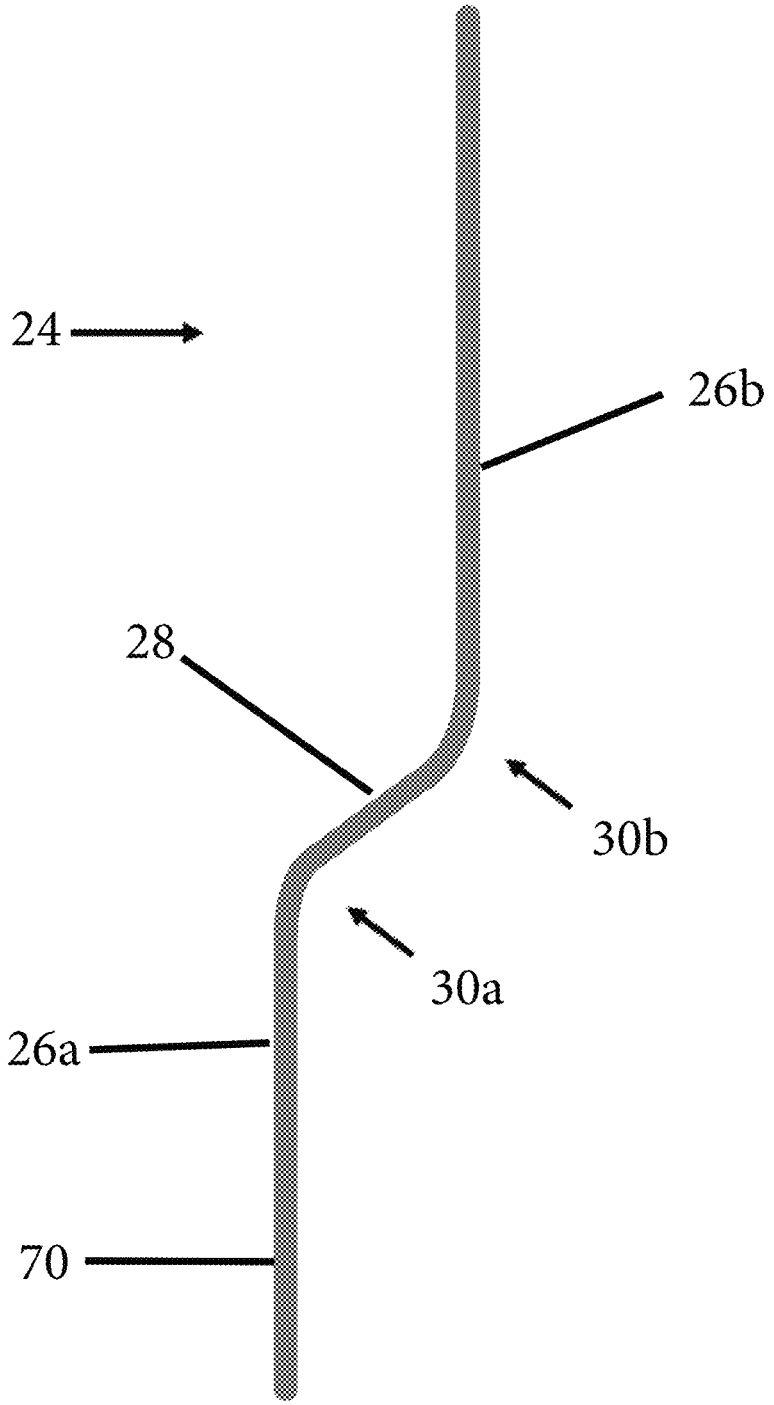
FIG. 16 illustrates a perspective view of a spine according to some embodiments of this disclosure.

The spine 24 has a curvilinear shape with vertical sections 26*a,b*, a horizontal section 28, and curved sections 30*a*, 30*b* (see e.g. FIGS. 2 and 16). Curved section 30*a* extends between the vertical section 26*a* and the horizontal section 28 and curved section 30*b* extends between the horizontal section 28 and the vertical section 26*b* (see e.g. FIG. 16). In one particular embodiment of example 100, the vertical section 26 has a length of approximately 4 inches and the horizontal section 28 has a length of approximately 3 inches.

In one particular embodiment of example 100, the beverage receptacle 20 has a diameter BD of approximately 3 inches, a diameter AD of approximately 3.125 inches, and the spine 24 has a vertical section 26 with a length of approximately 4 inches and a horizontal section 28 with a length of approximately of 3 inches.

Figure 3:
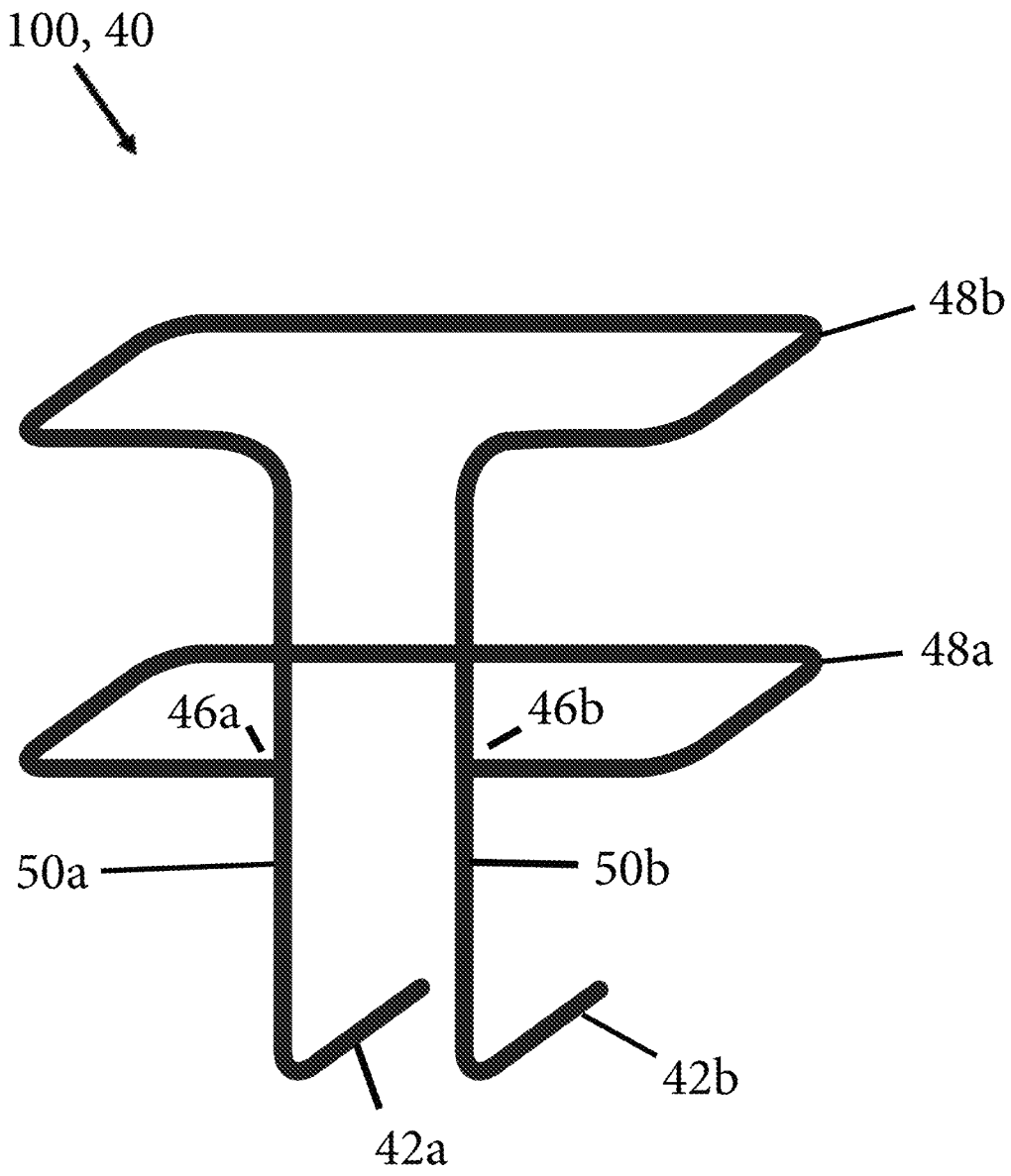
FIG. 3 illustrates a perspective view of the accessory receptacle of the beverage holder of FIG. 1.
Figure 5:
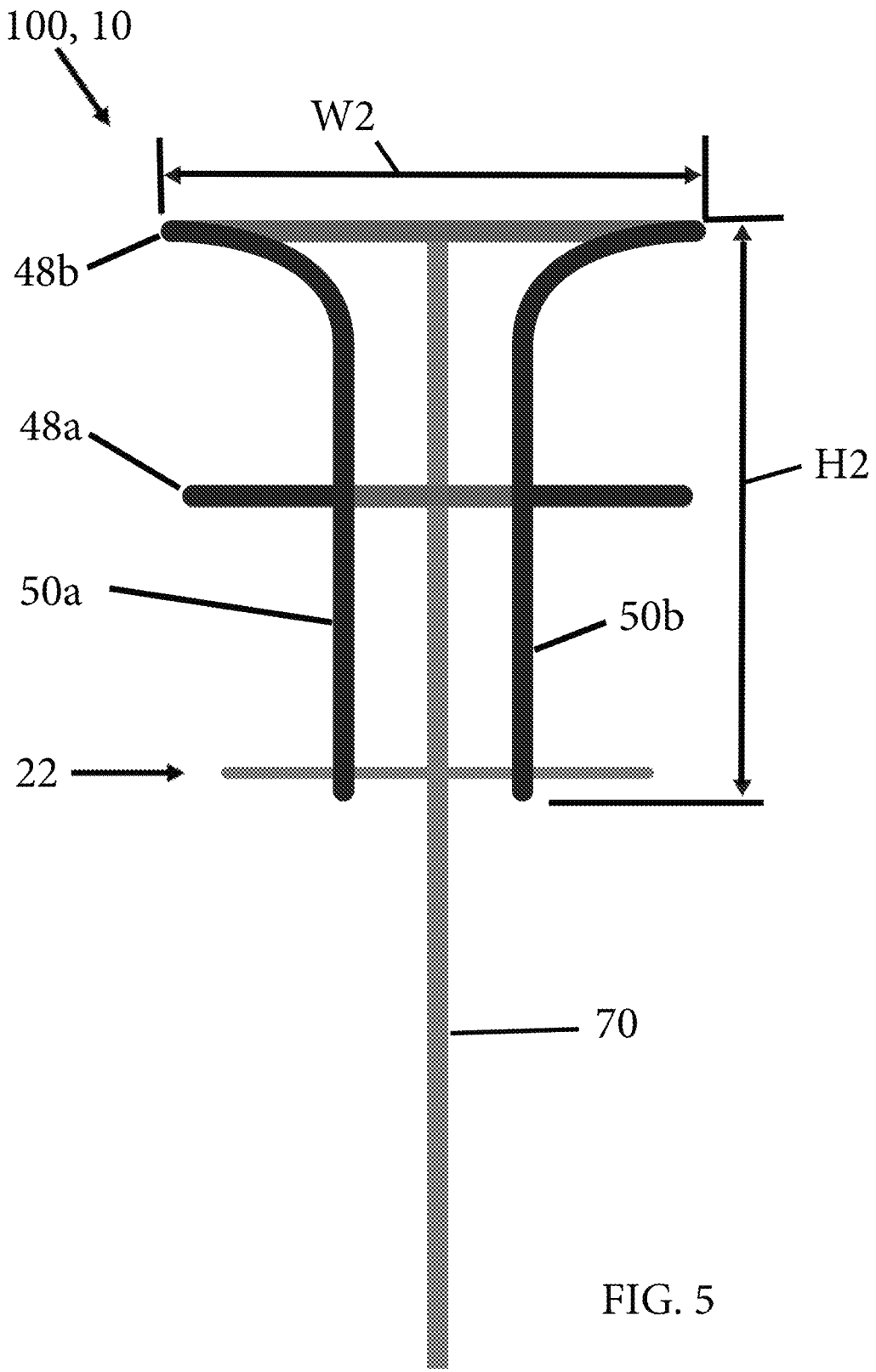
FIG. 5 illustrates a front view of the beverage holder of FIG. 1.

The accessory receptacle 40 has two horizontal support members 42*a,b*, two arms 48*a,b*, two segments 50, a height H2, and a width W2*a* (see e.g. FIGS. 3 and 5). In one particular embodiment of example 100, the accessory receptacle has a height H2 of approximately 4 inches, a width W2*a* of approximately 3.75 inches, and a depth D2 of approximately 0.75 inches. In this example, segments 50 extend vertically. The horizontal support members 42*a,b* are parallel to one another, connected to the base 22, and are separated by a width W2*b* (see e.g. FIG. 4). In one particular embodiment of example 100, the width W2*b* is approximately 1.125 inches.

When viewed from above, the arms 48*a,b* form a rectangular shape with an internal width IW and an internal depth D2*b* (see e.g. FIGS. 4 and 7). In one particular embodiment of example 100, the internal width IW is approximately 3.5 inches, and the internal depth D2*b* is approximately 0.75 inches. The internal depth D2*b* is less than the length of the horizontal support member 42 (see e.g. FIG. 7). The arms 48*a,b* and the horizontal support members 42 or base 22 are equidistant (see e.g. FIGS. 3, 5, 6).

In one particular embodiment of example 100, the accessory receptacle 40 has a height H2 of approximately 4 inches, a width W2*a* of approximately 3.75 inches, a depth D2 of approximately 0.75 inches, a width W2*b* of approximately 1.125 inches, an internal width IW of approximately 3.5 inches, and an internal depth D2*b* of approximately 0.75 inches.

In one particular embodiment of example 100, the beverage holder 10 has a height of approximately 4 inches, a width W of approximately 4.75 inches; the beverage receptacle 20 has a diameter BD of approximately 3 inches, a diameter AD of approximately 3.125 inches, and the spine 24 has a vertical section 26 with a length of approximately 4 inches and a horizontal section 28 with a length of approximately of 3 inches; and the accessory receptacle 40 has a height H2 of approximately 4 inches, a width W2*a* of approximately 3.75 inches, a depth D2 of approximately 0.75 inches, a width W2*b* of approximately 1.125 inches, an internal width IW of approximately 3.5 inches, and an internal depth D2*b* of approximately 0.75 inches.

Example 2

FIGS. 8-11 and 16 show a second example 200 of a beverage holder 10 with a beverage receptacle 20 and an accessory receptacle 40 positioned side by side. The beverage holder 10 has a height H1 and a width (see e.g. FIGS. 8-9). In one particular embodiment of example 200, the beverage holder 10 has a height H1 of approximately 4 inches and a width of approximately 4.5 inches.

Figure 11:
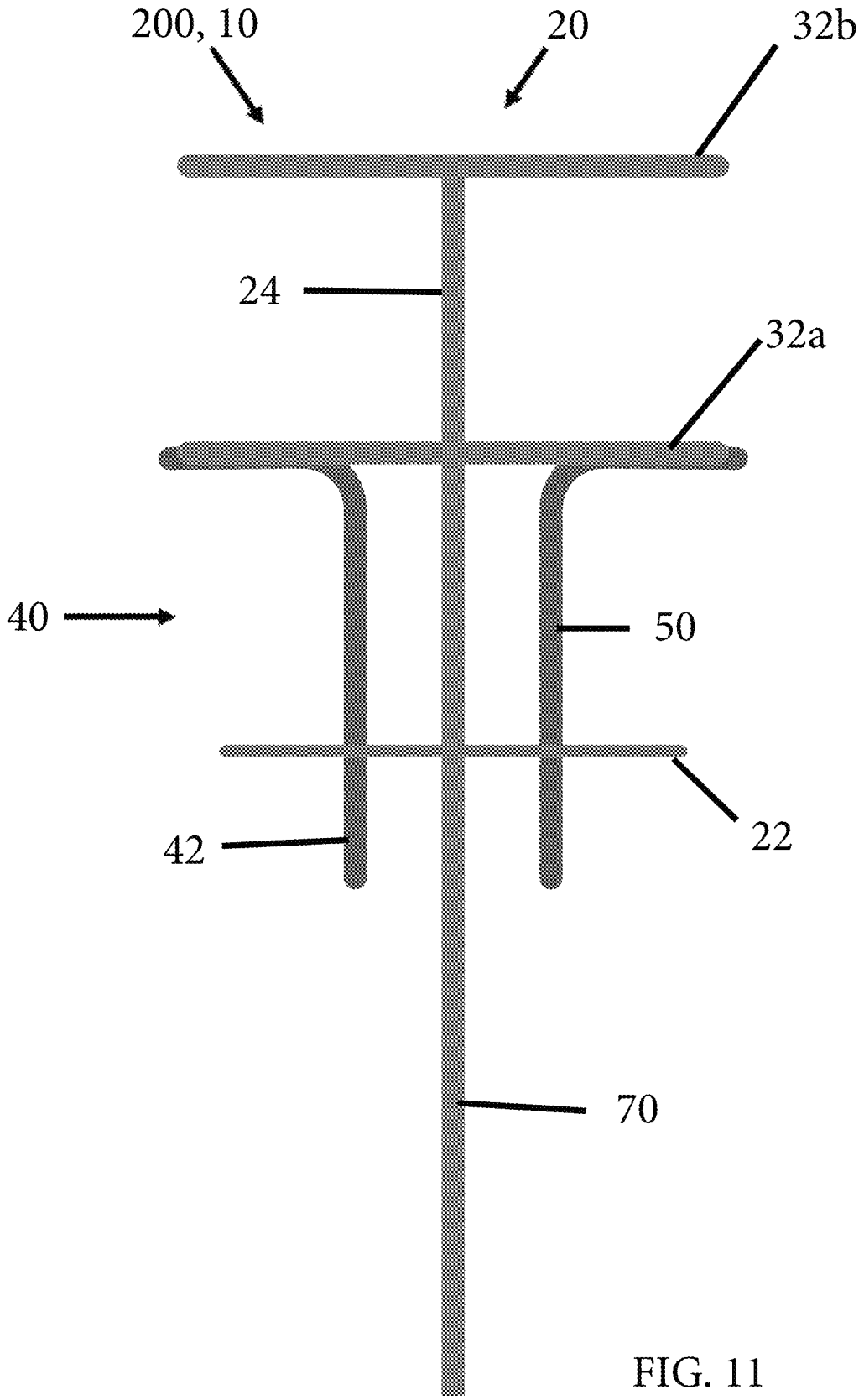
FIG. 11 illustrates a back view of the beverage holder of FIG. 8.

The beverage receptacle 20 has a base 22, two arms 32*a,b*, a spine 24, and a height H1 (see e.g. FIGS. 8 and 11). In one particular embodiment of example 200, the height H1 is approximately 4 inches. When viewed from above, the arms 32*a,b* are parallel to the base 22 and form a circular shape with a diameter AD greater than the diameter DB of the base 22 (see e.g. FIG. 9). In one particular embodiment of example 200, diameter BD is approximately 3 inches and diameter AD is approximately 3.125 inches.

The spine 24 has a curvilinear shape with vertical sections 26*a,b*, a horizontal section 28, and curved sections 30*a,b* (see e.g. FIGS. 8 and 16). Curved section 30*a* extends between the vertical section 26*a* and the horizontal section 28 and curved section 30*b* extends between the horizontal section 28 and the vertical section 26*b* (see e.g. FIG. 16). In one particular embodiment of example 200, the vertical section 26 has a length of approximately 4 inches and the horizontal section 28 has a length of approximately 3 inches.

In one particular embodiment of example 200, the beverage receptacle 20 has a height H1 of approximately 4 inches, a diameter BD of approximately 3 inches, a diameter AD of approximately 3.125 inches, and the spine 24 has a vertical section 26 with a length of approximately 4 inches and a horizontal section 28 with a length of approximately of 3 inches.

Figure 10:
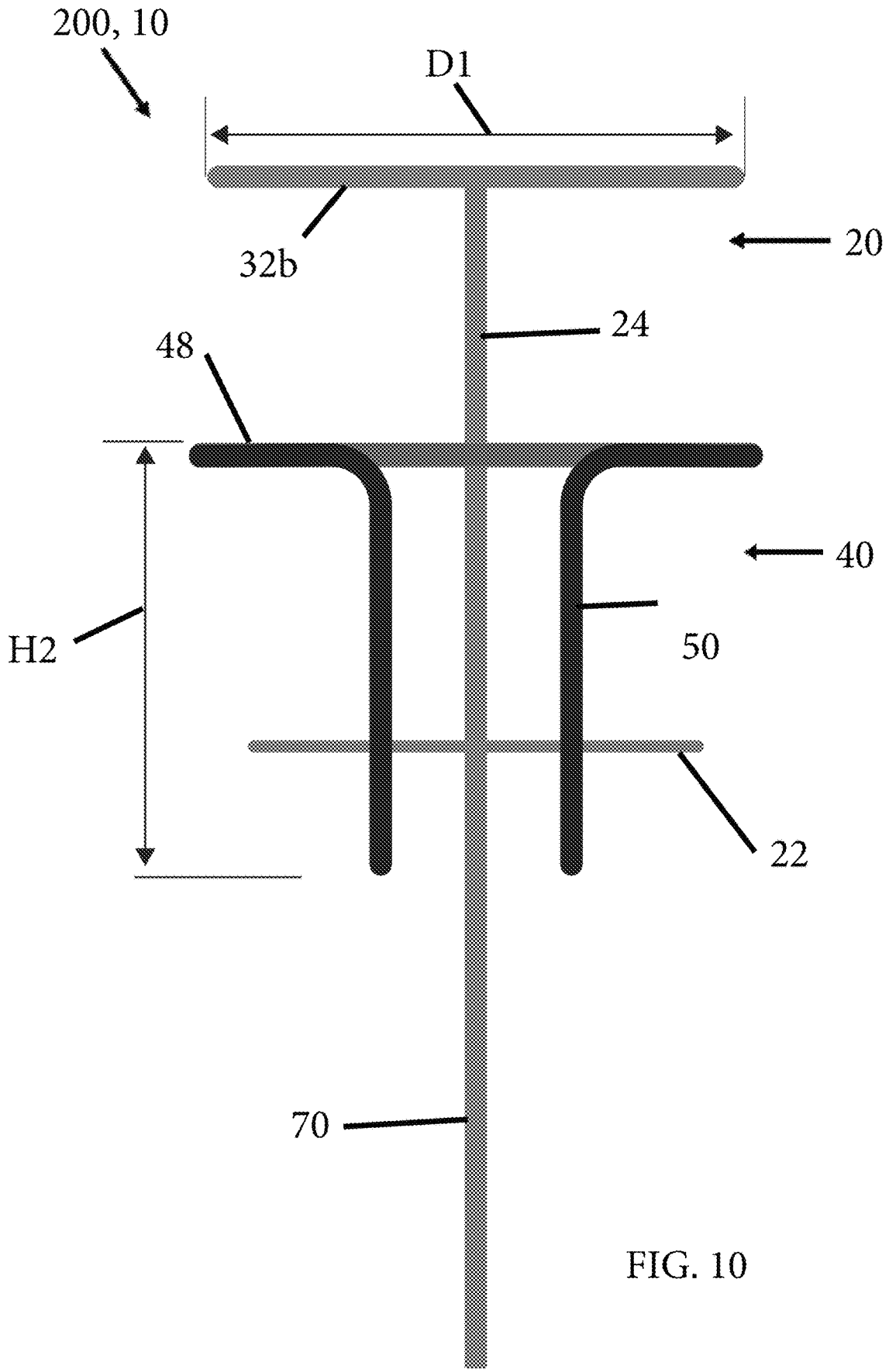
FIG. 10 illustrates a front view of the beverage holder of FIG. 8.

The accessory receptacle 40 has two horizontal support members 42*a,b*, one arm 48, two segments 50, a height H2, an internal width IW, and an internal depth D2*b* (see e.g. FIGS. 8-10). In this example, segments 50 extend vertically. The accessory receptacle 40 of example 100 may be formed by a single rod of steel. The height H2 of the accessory receptacle 40 is less than the height H1 of the beverage receptacle 20 (see e.g. FIGS. 8 and 10).

The horizontal support members 42*a,b* are parallel and are separated by a width W2*b* (see e.g. FIG. 9). The horizontal support members 42*a,b* include a u-shaped portion 44 with a depth D2*a* (see e.g. FIG. 8). When viewed from above, arm 48 forms a rectangular shape with an internal width IW and a depth D2*b* (see e.g. FIG. 9). Depth D2*b* is less than the horizontal length of the horizontal support member 42 (see e.g. FIG. 8).

In one particular embodiment of example 200, the accessory receptacle 40 has a height H2 of approximately 4 inches, a width W2*a* of approximately 3.75 inches, an internal width IW of approximately 3.5 inches, a depth D2*b* of approximately 0.75 inches, a depth D2*a* of approximately 0.615 inches, and a width W2*b* of approximately 1.125 inches.

In one particular embodiment of example 200, the beverage holder 10 has a height H of approximately 4 inches and a width of approximately 4 inches; the beverage receptacle 20 has a height H1 of approximately 4 inches, a diameter AD of approximately 3 inches, a diameter AD of approximately 3.125 inches, the spine 24 has a vertical section 26 with a length of approximately 4 inches and a horizontal section 28 with a length of approximately of 3 inches; and the accessory receptacle 40 has a height H2 of approximately 4 inches, a width W2*a* of approximately 3.75 inches, an internal width 1W of approximately 3.5 inches, a depth D2*b* of approximately 0.75 inches, a depth D2*a* of approximately 0.615 inches, and a width W2*b* of approximately 1.125 inches.

Example 3

FIGS. 12 and 16 show a third example 300 of beverage holder 10 with a beverage receptacle 20 and an accessory receptacle 40 positioned side by side. The beverage holder 10 of example 300 differs from the example 100 discussed above in that the accessory receptacle 40 is a box 54. Otherwise, the dimensions and attributes of the beverage holder 10 of example 300 are the same as described above for example 100.

Box 54 has a front wall 56, a back wall 58, a top opening, a bottom 60, and sidewalls. Box 54 has a height H2, a depth D2*b*, a width (see e.g. W2*a* as shown in FIGS. 4 and 5), and defines an internal width (see e.g. IW as shown in FIG. 4). In one particular embodiment of example 300, box 54 has a height H2 of approximately 4 inches, a width W2*a* of approximately 3.75 inches, an internal width IW of approximately 3.5 inches, and a depth D2 of approximately 0.75 inches. Box 54 (walls 56 and bottom) may be constructed of solid material and/or a mesh. Alternatively, the sidewalls and/or bottom 60 may be constructed of horizontal support members 42, instead of a solid material or a mesh.

In one particular embodiment of example 300, the beverage holder 10 has a height H of approximately 4 inches, a width W of approximately 4.75 inches; the beverage receptacle 20 has a diameter BD of approximately 3 inches, a diameter AD of approximately 3.125 inches, the spine 24 has a vertical section 26 with a length of approximately 4 inches and a horizontal section 28 with a length of approximately of 3 inches; and the accessory receptacle 40 has a height H2 of approximately 4 inches, a width W2*a* of approximately 3.75 inches, an internal width IW of approximately 3.5 inches, and a depth D2 of approximately 0.75 inches.

Example 4

FIGS. 13 and 16 show a fourth example 400 of beverage holder 10 with a beverage receptacle 20 and an accessory receptacle 40 positioned side by side. The beverage holder 10 of example 400 differs from the example 200 discussed above in that the accessory receptacle 40 is a box 54. Otherwise, the dimensions and attributes of the beverage holder 10 of example 400 are the same as described above for example 200.

Box 54 has a height H2, a depth D2*b*, and a width (see e.g. W2*a* as shown in FIGS. 4 and 5) and defines an internal width (see e.g. 1W as shown in FIG. 4). In one particular embodiment of example 300, box 54 has a height H2 of approximately 2.75 inches, a width W2*a* of approximately 3.75 inches, an internal width IW of approximately 3.5 inches, and a depth D2 of approximately 0.75 inches.

Box 54 has a front wall 56, a back wall 58, a top opening, a bottom 60, and sidewalls. Box 54 (walls 56 and bottom) may be constructed of solid material and/or a mesh. Alternatively, the sidewalls and/or bottom 60 may be constructed of horizontal support members 42, instead of a solid material or a mesh. The bottom 60 includes a u-shaped portion 44 with a depth D2*a* (see e.g. FIG. 13). In one particular embodiment of example 300, the depth D2*a* is approximately 0.625 inches.

In one particular embodiment of example 200, the beverage holder 10 has a height H of approximately 4 inches and a width of approximately 4 inches; the beverage receptacle 20 has a height H1 of approximately 4 inches, a diameter BD of approximately 3 inches, a diameter AD of approximately 3.125 inches, and the spine 24 has a vertical section 26 with a length of approximately 4 inches and a horizontal section 28 with a length of approximately of 3 inches; and the accessory receptacle 40 has a height H2 of approximately 2.75 inches, a width W2*a* of approximately 3.75 inches, an internal width IW of approximately 3.5 inches, and a depth D2 of approximately 0.75 inches.

Example 5

Figure 18:
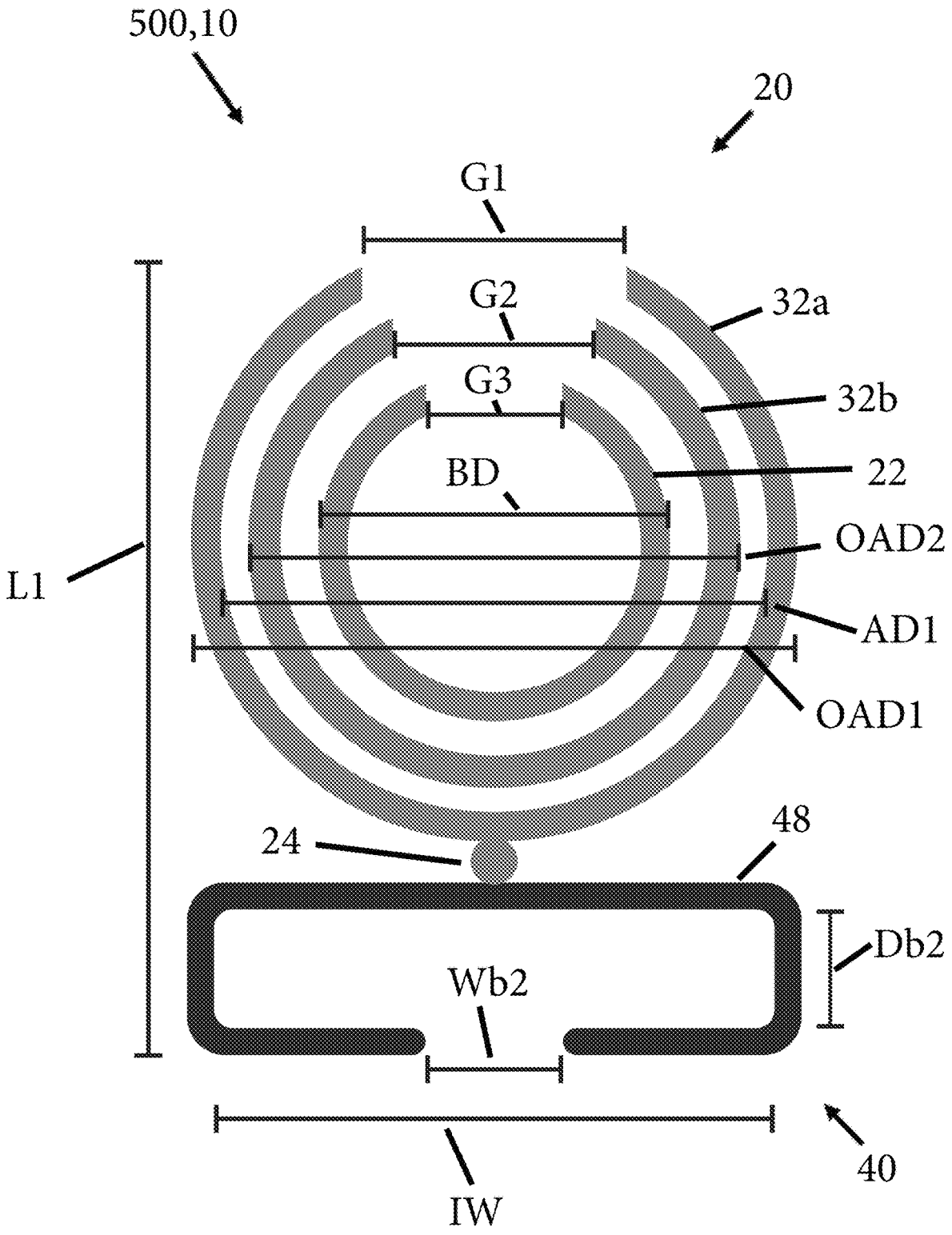
FIG. 18 illustrates a top view of the beverage holder of FIG. 17.
Figure 19:
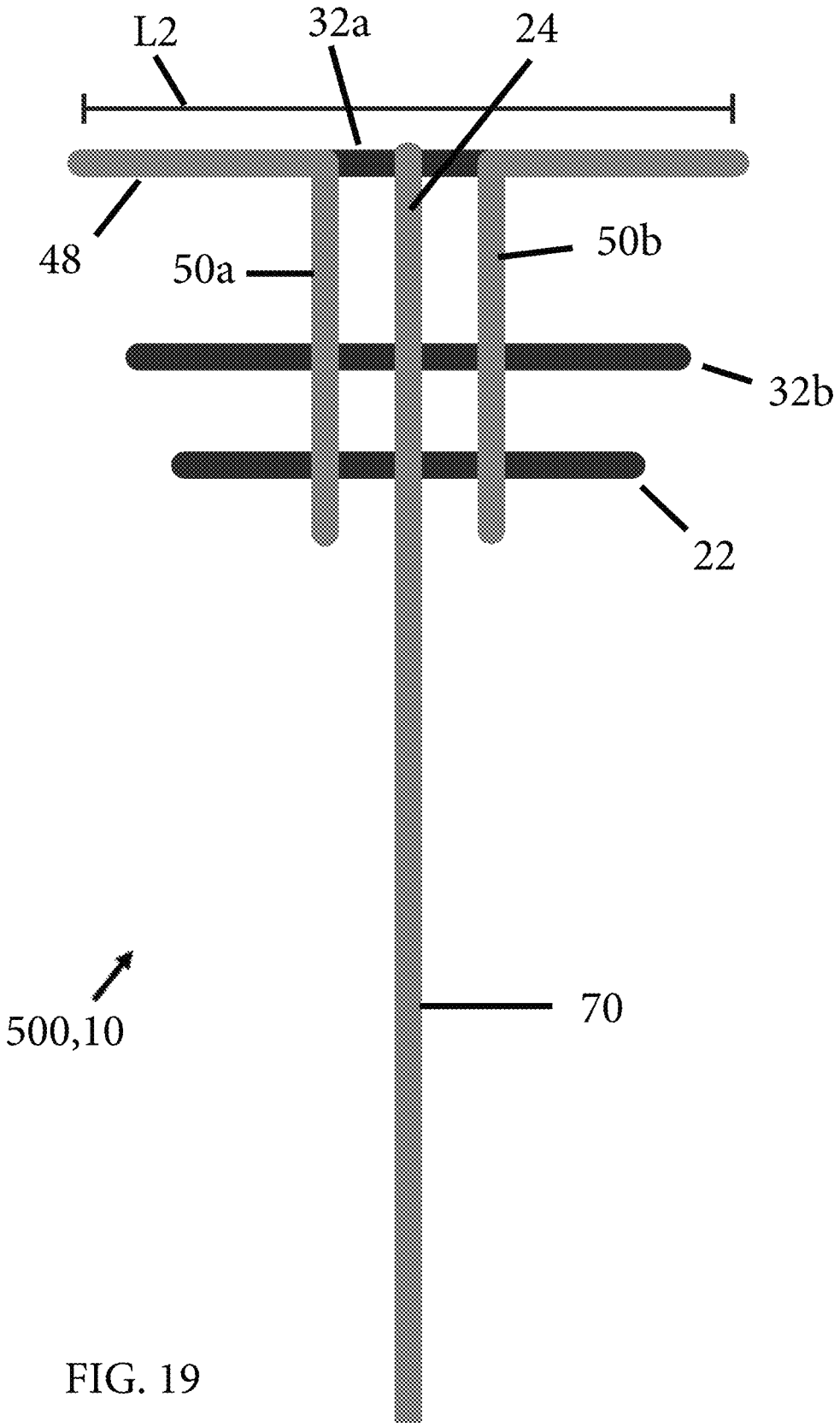
FIG. 19 illustrates a back view of the beverage holder of FIG. 17.

FIGS. 17-19 show a fifth example 500 of beverage holder 10 with a beverage receptacle 20 and an accessory receptacle 40. The beverage receptacle 20 and the accessory receptacle 40 are positioned side by side and have different heights (FIG. 17). In this example, the height of the accessory receptacle 40 is greater than the height of the beverage receptacle 20 (FIG. 17). In one particular embodiment of example 500, the beverage receptacle 20 has a height of approximately 2 inches. In this example, the beverage receptacle 20 and the accessory receptacle 40 are connected by the spine 24 (FIG. 18). The spine 24 has a curvilinear shape (FIG. 17).

The spine 24 connects the arms 32*a,b* of the beverage receptacle 20 (see e.g. FIG. 17). When viewed from above, the arms 32*a,b* form a circular shape with a gap G1,G2 between ends of the arms 32*a,b* and the base 22 has a gap G3 (see e.g. FIG. 18). As shown in FIG. 18, the gaps G1,G2,G3 are different lengths with G1>G2>G3. In one example, the difference between each gap G1,G2,G3 is 0.25 inches. In one particular embodiment of example 500, G1 is 1.75 inches, G2 is 1.25 inches and G3 is 0.75 inches.

The base 22 of the beverage receptacle 20 is flat and circular. In this example, base 22 has the same structure as the structure forming the arms 32*a,b* (FIG. 18). In this example, the base 22 and arms 32*a*,32*b* have different diameters (DB, OAD1, AD1, OAD2) with arm 32*a* having the greatest diameter OAD1 and the base 22 having the smallest diameter DB. As shown in FIG. 18, the difference between diameter AD1 and OAD1 is the diameter of the arm 32*a*. In one aspect, the different diameters allow the beverage holder 10 to hold beverage containers of different sizes. For example, a larger beverage container may rest on arm 32*b* while a smaller beverage container may rest on base 22. In one particular embodiment of example 500, diameter BD is approximately 2 inches, diameter OAD2 is approximately 3 inches and diameter OD1 is approximately 3.5 inches. In another particular embodiment of example 500, diameter BD is 2.25 inches, diameter OAD2 is 3.25 inches, diameter AD1 is 3.6 inches, and diameter OAD1 is 4 inches.

In this example, base 22 is connected to arm 48 of the accessory receptacle, with arm 48 connected to the spine 24 (FIG. 17). In other embodiments, both the base 22 and arm 48 may be connected to the spine 24.

In one particular embodiment of example 500, the beverage holder has a length L1 of approximately 4.5 inches and the beverage receptacle 20 has a diameter OAD1 of approximately 3.5 inches. In another particular embodiment of example 500, the beverage holder has a length L1 of approximately 5.25 inches and an OAD1 of approximately 4 inches.

The accessory receptacle 40 has an arm 48, segments 50*a,b*, a u-shaped portion 44, support members 42, a height, a depth Db2, and a width IW (see e.g. FIGS. 18-19). In this example, segments 50*a,b* extend downward at a non-vertical angle to a u-shaped portion 44 forming the bottom 60 of the accessory receptacle 40 (FIG. 17). Support members 42 extend from the u-shaped portion 44. In some embodiments, the support members 42 are attached to the spine 24 and/or shaft 70. In other embodiments, the support members 42 are further attached to the base 22 (see e.g. FIG. 17). In one particular embodiment of example 500, the accessory receptacle has a width IW of approximately 4 inches and a depth Db2 of approximately 0.75 inches.

When viewed from above, arm 48 forms a rectangular shape at the top of the accessory receptacle 40 with a gap Wb2 (FIG. 18). In one particular embodiment of example 500, the width of gap W2*b* is approximately 1 inch. The arm 48 extends downward at a non-perpendicular angle from the rectangular top to a curved bottom 60 (FIG. 17). In this example, arm 48 is attached to the spine 24 and the base 22.

When viewed from above, arm 48 forms a rectangular shape with an internal width IW, an internal depth D2*b*, and defines a gap Wb2 (FIG. 18). In one particular embodiment of example 100, the internal width IW is approximately 4 inches, the internal depth D2*b* is approximately 0.75 inches, and the gap Wb2 is approximately 1 inch.

In one particular embodiment of example 500, the beverage holder has a length L1 of approximately 4.5 inches, the beverage receptacle 20 has a diameter OAD1 of approximately 3.5 inches, an arm 32*a* with a diameter of approximately 3.5 inches, a gap G2 of approximately 1.75 inches, an arm 32*b* with a diameter of approximately 3 inches and a gap G2 of approximately 1.25 inches, a base with a diameter of approximately 2 inches and a cap G3 of approximately 0.75 inches, an accessory holder 40 with a Db2 of approximately 1 inch, a Wb2 of approximately 1 inch, and an IW of approximately 4 inches.

Example 6

Figure 25:
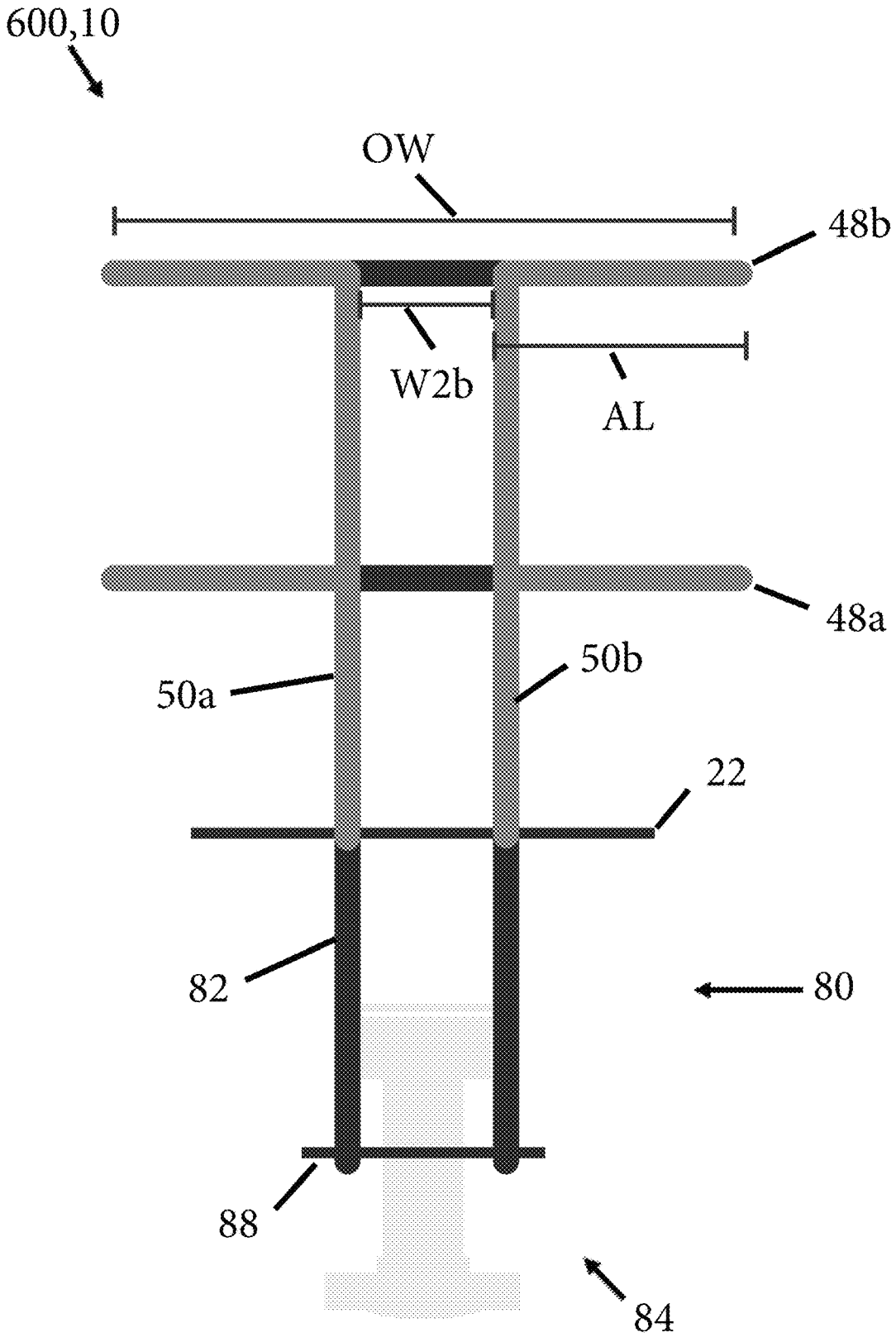
FIG. 25 illustrates a back view of the beverage holder of FIG. 23.

FIGS. 23-25 show a sixth example 600 of a beverage holder 10 with a beverage receptacle 20, an accessory receptacle 40, and a mounting device 80. The beverage receptacle 20 and the accessory receptacle 40 are positioned side by side and have the same height (FIG. 24). The beverage receptacle 20 and the accessory receptacle 40 are connected by arms 48*a* and 32*a*, and by arms 48*b* and 32*b*. In one particular embodiment of example 100, the beverage holder 10 has a height (H1+BH) of approximately 5 inches, a width L3 of approximately 6 inches, and a depth OW of approximately 4.125 inches (FIGS. 24-25).

The beverage receptacle 20 has a base 22, two arms 32*a,b*, and a height H1 (see e.g. FIG. 24). In one particular embodiment of example 100, the height H1 is approximately 3.75 inches. The base 22 is flat and circular with a diameter BD (FIG. 23). The edge of base 22 is positioned at a distance L2 from an end of the accessory holder 40 (FIG. 24). When viewed from above, the arms 32*a,b* are parallel to the base 22 and form a circular shape with a diameter AD1 greater than the diameter BD (FIG. 23). In one particular embodiment of example 600, diameter BD is approximately 3 inches, diameter AD is approximately 3.125 inches, and a diameter OAD of 3.625 inches. The arms 32*a* and 32*b* are separated by a distance S1 and arm 32*a* and horizontal support member 42 are separated by a distance S2 (FIG. 24). Although in this example distance S1 is greater than distance S2, distance S1 may also be equal to or less than distance S2. In one particular embodiment of example 600, distance S1 is approximately 1.7 inches and distance S2 is approximately 1.4 inches.

The accessory receptacle 40 has two horizontal support members 42*a,b* extending from two segments 50*a,b*, two arms 48*a,b*, a height H2, an interior width IW, and an outer width OW (see e.g. FIGS. 24-25). In this example, segments 50 extend vertically. The horizontal support members 42*a,b* are parallel to one another, connected to the base 22, and are separated by a width W2*b* (see e.g. FIG. 25). In one particular embodiment of example 100, the width W2*b* is approximately 0.65 inches.

When viewed from above, the arms 48*a,b* form a rectangular shape with an internal width IW and an internal depth D2*b* (FIGS. 23 and 25). Arms 48*a,b* are separated by distance S1 and arm 48*a* is separated from horizontal support members 42 by distance S2 (FIG. 24).

The mounting device 80 has a bracket 81, adjustment/securement device 84, a height BH, a width BW, and a depth (FIG. 24). In this example, bracket 81 is formed by a member 82. In some embodiments of example 600, the top segment 82*a* of member 82 is an extension of the horizontal support members 42. In other embodiments of example 600, the top segment 82*a* of member 82 is a separate component from the horizontal support members 42, and top segment 82*a* and horizontal support members 42 are each attached to the base 22. In some embodiments, the plates 83,88 have the shape shown in FIG. 22. In at least one embodiment, each of the upper bracket plate 83*b* and the screw plate 88 has a pad 89. In some embodiments, of example 600, the securement device 84 is the securement device 84 shown in FIG. 21, discussed in greater detail above.

The mounting device 80 is positioned a distance L1 away from the end of the accessory receptacle 40 (FIG. 24). In one example, distance L1 is approximately 3 inches, height BH is approximately 2.2 inches, and width BW is approximately 3 inches.

In one particular embodiment of example 500, PD1 is approximately 1.25 inches, PW1 is approximately 1.625 inches, BD is approximately 2.95 inches, AD is approximately 3.25 inches, OAD is approximately 3.625 inches, DB2 is approximately 0.75 inches, W2*b* is approximately 0.65 inches, IW is approximately 3.625 inches, AD2 is approximately 4.75 inches, H1/H2 is approximately 3.75 inches, S1 is approximately 1.7 inches, S2 is approximately 1.4 inches, L1 is approximately 3 inches, L2 is approximately 1.25 inches, L3 is approximately 6 inches, BH is approximately 2.2 inches, BW is approximately 3 inches, OW is approximately 4.125 inches, AL is approximately 1.74 inches, SW is approximately 2.125 inches, SH1 is approximately 0.5 inches, SH2 is approximately 1.125 inches, SH3 is approximately 0.5 inches.

Other embodiments of the present disclosure are possible. Although the description above contains much specificity, these should not be construed as limiting the scope of the disclosure, but as merely providing illustrations of some of the presently preferred embodiments of this disclosure. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form various embodiments. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

The foregoing description of various preferred embodiments of the disclosure have been presented for purposes of illustration and description. It is not intended to be exhaustive or to limit the disclosure to the precise embodiments, and obviously many modifications and variations are possible in light of the above teaching. The example embodiments, as described above, were chosen and described in order to best explain the principles of the disclosure and its practical application to thereby enable others skilled in the art to best utilize the disclosure in various embodiments and with various modifications as are suited to the particular use contemplated. It is intended that the scope of the disclosure be defined by the claims appended hereto.

Various examples have been described. These and other examples are within the scope of the following claims.

What is claimed is:

1. A beverage holder comprising a beverage receptacle and an accessory receptacle positioned side by side:

the beverage receptacle defining a cylindrical volume, the beverage receptacle comprising:

a flat base for supporting a beverage container, the flat base having a circular shape with a first diameter;

a first arm having a second diameter and at least partially encircling the cylindrical volume; and a spine connecting the flat base and the first arm;

the accessory receptacle defining a rectangular volume, wherein the accessory receptacle is directly connected to the flat base and to the first arm of the beverage receptacle; and a shaft comprising a first section connected to the flat base, and a second section with a pointed end for securing the beverage holder into the ground, the first and second sections connectable by a threaded section.

2. The beverage holder of claim 1, the spine comprising:

a first curved section extending between the first section of the shaft and a horizontal section of the spine, wherein the horizontal section extends under, and is connected to the flat base;

a second curved section extending between the horizontal section and a vertical section, the vertical section connected to the flat base and to the first arm of the beverage receptacle.

3. The beverage holder of claim 2, wherein the beverage receptacle further comprises a second arm with a third diameter equal to the second diameter, the first arm positioned above the flat base, the second arm positioned above the first arm, the beverage receptacle having a height; and the accessory receptacle has a height equal to the height of the beverage receptacle and is further connected to the second arm of the beverage receptacle.

4. The beverage holder of claim 3, wherein the accessory receptacle comprises a horizontal support member, a vertical section, a first arm member, and a second arm member positioned above the first arm member, wherein:

the horizontal support member connects the accessory receptacle to the flat base;

the vertical section interconnects the horizontal support member, the first arm member and the second arm member;

wherein the accessory receptacle is connected to the first arm of the beverage receptacle by the first arm member and to the second arm of the beverage receptacle by the second arm member.

5. The beverage holder of claim 4, wherein the second diameter is greater than the first diameter.

6. The beverage holder of claim 4, wherein the first and second arms encircle the cylindrical volume.

7. The beverage holder of claim 3, wherein the accessory receptacle is a box comprising a front wall, a rear wall, side walls, and a bottom, wherein the rear wall is connected to the first arm and to the second arm of the accessory receptacle.

8. The beverage holder of claim 7, wherein at least one of the front wall, the rear wall, the side walls, and the bottom is a mesh.

9. The beverage holder of claim 2, wherein the beverage receptacle further comprises a second arm with a third diameter equal to the second diameter, the first arm positioned above the flat base, the second arm positioned above the first arm, the beverage receptacle having a height; and the accessory receptacle has a height less than the height of the beverage receptacle, wherein the accessory receptacle is connected to the first arm but not to the second arm of the beverage receptacle.

10. The beverage holder of claim 9, wherein the accessory receptacle comprises a horizontal support member, a vertical portion, and one arm member, wherein:

the horizontal support member connects the accessory receptacle to the flat base;

the vertical section interconnects the horizontal support member and the arm member;

wherein the arm member is connected to the first arm of the beverage receptacle.

11. The beverage holder of claim 10, wherein the horizontal support member, the vertical portion, and the arm member of the accessory receptacle is a single piece of material.

12. The beverage holder of claim 9, wherein the accessory receptacle is a box with a front wall, a rear wall, and a bottom, wherein the rear wall is connected to the first ann.

13. The beverage holder of claim 12, wherein at least one of the front wall, the rear wall, the side walls, and the bottom is a mesh.

14. The beverage holder of claim 1, the accessory receptacle and the beverage receptacle are positioned side-by side in a horizontal direction.

15. A beverage holder comprising a beverage receptacle and an accessory receptacle positioned side by side:

the beverage receptacle defining a cylindrical volume, the beverage receptacle having a first height and comprising:

a flat base for supporting a beverage container, the flat base having a circular shape with a diameter;

a first arm positioned above the flat base;

a second arm positioned above the first arm;

a spine connecting the flat base and the first and second arms, the spine comprising:

a first curved section extending from a horizontal section extending under, and connected to the flat base;

a second curved section extending between the horizontal section and a vertical section, the vertical section connected to the first and second arms of the beverage receptacle;

the accessory receptacle defining a rectangular volume, the accessory receptacle having a second height equal to the first height, wherein the accessory receptacle is connected to the flat base, the first arm, and the second arm of the beverage receptacle; and a shaft comprising:

a first section connected to the flat base and the first curved section of the spine; and a second section with a pointed end for securing the beverage holder into the ground, the first and second sections connectable by a threaded section.

* * * * *